US008951079B2

(12) United States Patent
Railey et al.

(10) Patent No.: US 8,951,079 B2
(45) **Date of Patent: *Feb. 10, 2015**

(54) MOTORIZED WATERCRAFT SYSTEM WITH INTERCHANGEABLE MOTOR MODULE

(75) Inventors: Mike R Railey, Del Mar, CA (US); Michael Vlock, Branford, CT (US)

(73) Assignee: Boomerboard, LLC, Branford, CT (US)

( * ) Notice: Subject to any disclaimer, the term of this patent is extended or adjusted under 35 U.S.C. 154(b) by 432 days.

This patent is subject to a terminal disclaimer.

(21) Appl. No.: 13/174,277

(22) Filed: Jun. 30, 2011

(65) Prior Publication Data

US 2012/0000409 A1 Jan. 5, 2012

Related U.S. Application Data

(60) Provisional application No. 61/360,836, filed on Jul. 1, 2010, provisional application No. 61/430,332, filed on Jan. 6, 2011.

(51) Int. Cl.

| | |
|---|---|
| ***B63B 35/71*** | (2006.01) |
| ***B63B 35/73*** | (2006.01) |
| ***B63B 35/79*** | (2006.01) |
| ***B63H 5/16*** | (2006.01) |
| ***B63H 11/04*** | (2006.01) |
| ***B63H 11/08*** | (2006.01) |
| ***B63H 21/12*** | (2006.01) |

(Continued)

(52) U.S. Cl.

CPC ..... *B63B 35/79* (2013.01); *B63B 35/7943* (2013.01); *B63B 35/7946* (2013.01); *B63H 11/00* (2013.01); *B63H 21/12* (2013.01); *B63H 21/24* (2013.01); *B63H 21/30* (2013.01)

USPC ..... 441/74; 440/6

(58) Field of Classification Search

CPC .... B63B 35/73; B63B 35/79; B63B 35/7909; B63B 35/7943; B63H 5/16; B63H 11/04; B63H 11/08; B63H 21/12; B63H 21/17; B63H 21/22

USPC ..... 440/6, 7, 38; 441/65, 74–79

See application file for complete search history.

(56) References Cited

U.S. PATENT DOCUMENTS

| | | | |
|---|---|---|---|
| 1,667,912 | A | 5/1928 | Vlahon |
| 3,262,413 | A | 7/1966 | Douglas et al. |

(Continued)

FOREIGN PATENT DOCUMENTS

| | | | |
|---|---|---|---|
| DE | 3139816 | 5/1983 | |
| DE | 4404241 A1 * | 8/1995 | ..... B63B 35/79 |

(Continued)

OTHER PUBLICATIONS

Written Opinion of the International Preliminary Examining Authority for PCT/US2011/042617 dated Jul. 31, 2012.

(Continued)

*Primary Examiner* — Ajay Vasudeva

(74) *Attorney, Agent, or Firm* — Knobbe, Martens, Olson & Bear LLP

(57) ABSTRACT

A personal watercraft body comprises a recess configured to receive similarly shaped cassettes. A first cassette may be motorized to propel the body relative to a body of water. A second cassette may be non-motorized and may include a storage space therein for storing personal items. An insert may be disposed between the cassettes and the recess to orient and fit the cassettes within the body.

14 Claims, 22 Drawing Sheets

(51) Int. Cl.

| | |
|---|---|
| ***B63H 21/17*** | (2006.01) |
| ***B63H 21/22*** | (2006.01) |
| ***B63H 11/00*** | (2006.01) |
| ***B63H 21/00*** | (2006.01) |
| ***B63H 21/30*** | (2006.01) |

(56) References Cited

U.S. PATENT DOCUMENTS

| | | | | |
|---|---|---|---|---|
| 3,536,025 | A | 10/1970 | Tierney | |
| 3,548,778 | A | 12/1970 | Von Smagala-Romanoff | |
| 3,826,220 | A | 7/1974 | Jacobson | |
| 3,929,549 | A | 12/1975 | Smith | |
| 4,020,782 | A | 5/1977 | Gleason | |
| 4,538,996 | A | 9/1985 | Inwood | |
| 4,811,682 | A | 3/1989 | Hwang et al. | |
| 4,883,436 | A | 11/1989 | Oakland | |
| 5,017,166 | A | 5/1991 | Chang | |
| 5,090,930 | A | 2/1992 | Walden | |
| 5,282,437 | A | 2/1994 | Avillez De Basto | |
| 5,396,860 | A | 3/1995 | Cheng | |
| 5,429,562 | A | 7/1995 | Milner | |
| 5,474,481 | A | 12/1995 | Ramsey | |
| 5,560,617 | A | 10/1996 | Liang | |
| 5,582,529 | A | 12/1996 | Montgomery | |
| 5,590,616 | A | 1/1997 | Vera | |
| 5,769,674 | A | 6/1998 | Stallman | |
| 5,807,152 | A | 9/1998 | Wojcik | |
| 5,943,978 | A | 8/1999 | Garnier | |
| 5,947,788 | A | 9/1999 | Derrah | |
| 6,142,840 | A | 11/2000 | Efthymiou | |
| 6,178,911 | B1 | 1/2001 | Hemphill | |
| 6,183,333 | B1 | 2/2001 | Hall | |
| 6,250,977 | B1 | 6/2001 | Ness | |
| 6,305,305 | B1 | 10/2001 | Johnson | |
| 6,305,307 | B1 | 10/2001 | Yokoya | |
| 6,311,631 | B1 | 11/2001 | Beecher | |
| 6,394,867 | B1 | 5/2002 | Bianco | |
| 6,409,560 | B1 | 6/2002 | Austin | |
| 6,461,204 | B1 | 10/2002 | Takura et al. | |
| 6,510,704 | B1 | 1/2003 | Russell | |
| 6,568,340 | B2 | 5/2003 | Dec et al. | |
| 6,662,742 | B2 | 12/2003 | Shelton et al. | |
| 6,702,634 | B2 | 3/2004 | Jung | |
| 6,793,552 | B2 | 9/2004 | Derrah | |
| 6,823,813 | B2 | 11/2004 | Mazin | |
| 6,901,872 | B1 | 6/2005 | Battle et al. | |
| 7,121,911 | B1 | 10/2006 | Hickman | |
| 7,198,532 | B2 | 4/2007 | Field | |
| 7,226,329 | B2 | 6/2007 | Railey | |
| 7,711,322 | B2 | 5/2010 | Rhodes et al. | |
| 7,731,555 | B2 | 6/2010 | Railey | |
| 7,930,985 | B2 * | 4/2011 | Walworth et al. | 114/55.58 |
| 7,993,178 | B2 | 8/2011 | Railey | |
| 8,290,636 | B2 | 10/2012 | Manning | |
| 8,398,446 | B2 * | 3/2013 | Railey et al. | 440/6 |
| 8,480,447 | B2 | 7/2013 | Railey | |
| 2001/0042498 | A1 * | 11/2001 | Burnham | 114/55.56 |
| 2002/0072285 | A1 | 6/2002 | Jung | |
| 2003/0167991 | A1 | 9/2003 | Namanny | |
| 2005/0042970 | A1 * | 2/2005 | Schwartz | 446/154 |
| 2006/0292942 | A1 | 12/2006 | Liao | |
| 2008/0045097 | A1 | 2/2008 | Railey | |
| 2008/0168937 | A1 * | 7/2008 | Ruan et al. | 114/55.56 |
| 2009/0093174 | A1 | 4/2009 | Rui | |
| 2009/0165690 | A1 | 7/2009 | Walworth et al. | |
| 2011/0056423 | A1 | 3/2011 | Railey | |
| 2011/0201238 | A1 * | 8/2011 | Rott et al. | 440/6 |
| 2011/0212691 | A1 | 9/2011 | Rott et al. | |
| 2011/0256518 | A1 | 10/2011 | Rott | |
| 2012/0126972 | A1 | 5/2012 | Rott et al. | |
| 2012/0196494 | A1 | 8/2012 | Preston | |

FOREIGN PATENT DOCUMENTS

| | | | | |
|---|---|---|---|---|
| DE | 20 2006 000210 | | 3/2006 | |
| DE | 10 2004 049615 | | 4/2006 | |
| FR | 2617793 | | 1/1989 | |
| JP | 61125992 | | 6/1986 | |
| JP | 01148694 | | 6/1989 | |
| JP | 2002-154479 | | 5/2002 | |
| JP | 2002 193185 | | 7/2002 | |
| JP | 2003 026085 | | 1/2003 | |
| TW | 200831353 | | 8/2008 | |
| WO | WO 2005058685 | A1 * | 6/2005 | B63B 35/73 |

OTHER PUBLICATIONS

International Search Report and Written Opinion issued in PCT Application PCT/US2011/042617 on Oct. 26, 2011.

* cited by examiner

MOTORIZED WATERCRAFT SYSTEM WITH INTERCHANGEABLE MOTOR MODULE

CROSS-REFERENCE TO RELATED APPLICATIONS

This application claims the benefit of U.S. Provisional Application No. 61/360,836 filed on Jul. 1, 2010, entitled "MOTORIZED WATERCRAFT WITH INTERCHANGEABLE MOTOR MODULE," and U.S. Provisional Application No. 61/430,332 filed on Jan. 6, 2011, entitled "MOTORIZED WATERCRAFT WITH INTERCHANGEABLE MOTOR MODULE," both of which are hereby incorporated by reference in their entireties.

BACKGROUND OF THE INVENTION

1. Field of the Invention

The present invention relates to motor driven watercraft.

2. Description of the Related Art

Surfing is the sport of riding a surfboard on the face of an ocean wave towards the shoreline. Jet powered surfboards have been devised and utilized for the purpose of surfing without waves such as in lakes or other calm waters. Several types of motorized water boards in the prior art include U.S. Pat. No. 6,702,634 to Jung; U.S. Pat. No. 6,409,560 to Austin; U.S. Pat. No. 6,142,840 to Efthymiou; U.S. Pat. No. 5,017,166 to Chang; and U.S. Pat. No. 4,020,782 to Gleason. Another powered surfboard design is described in U.S. Pat. No. 7,226,329 to Railey. This device uses small electric motors to provide power while maintaining traditional surfboard performance.

SUMMARY OF THE INVENTION

In one embodiment, a personal watercraft comprises a top surface, a bottom surface, and a cassette. The bottom surface may comprise a first recess extending generally toward the top surface and the cassette may be at least partially disposed within the first recess. The cassette may comprise at least one motor and the motor may be configured to propel the personal watercraft in at least a first direction relative to a body of water. The cassette may also comprise an impeller and the impeller may be positioned in a flow housing. The bottom surface may also comprise a second recess and a fin may be disposed at least partially within the second recess. The personal watercraft may also comprise an insert disposed at least partially between the cassette and the first recess. The insert may be coupled to the bottom surface and comprise a protrusion. The cassette may comprise an indentation that is configured to receive at least a portion of the protrusion. The cassette may be latched to the insert.

In another embodiment, a method of making a personal watercraft comprises forming a watercraft body with a recess in a bottom portion thereof, and placing a cassette at least partially within the recess. The cassette may be removably fastened or otherwise coupled to an insert.

In yet another embodiment, a method of making a personal watercraft comprises providing a cassette housing, placing a motor within the housing, placing an impeller within the housing, placing a battery within the housing, and enclosing the motor, impeller, and battery within the housing. The method may also comprise placing the cassette housing at least partially within a recess of a watercraft body.

In another embodiment, a personal watercraft kit comprises a personal watercraft, a motorized cassette, and a non-motorized cassette. The personal watercraft may comprise a top surface and a bottom surface. The bottom surface may comprise a recess that extends generally toward the top surface. The motorized cassette and the non-motorized cassette may each be configured to fit at least partially within the recess in the bottom surface.

In another embodiment, a system comprises an insert and a motorized cassette. The insert is configured to be secured relative to a watercraft, defines a receiving space, and comprises at least one protrusion extending into the receiving space. The motorized cassette is configured to be received at least partially within the receiving space and comprises at least one indentation configured to receive the at least one protrusion of the insert so as to inhibit movement of the cassette relative to the insert in at least one of a longitudinal direction, a transverse direction, and a lateral direction. The insert may comprise a latch configured to releasably secure the cassette relative to the insert when the cassette is at least partially received within the receiving space. The cassette may include an aperture, the insert may include a threaded bore, and the aperture and the threaded bore can be coaxially aligned when the cassette is at least partially receiving within the receiving space. The insert may be ring shaped. The cassette and the receiving space may be complimentary shaped so as to inhibit movement of the cassette relative to the insert.

DETAILED DESCRIPTION OF THE PREFERRED EMBODIMENT

Traditionally, the sport of surfing comprises a rider ("surfer") "paddling out" by lying prone on the surfboard and paddling away from the shoreline towards a point at which waves are cresting; turning to face the shoreline; paddling quickly towards the shoreline when a wave begins to crest so as to "catch the wave"; and "riding the wave" on the surfboard propelled by the wave towards the shoreline in a prone, sitting, or standing position. When riding a wave, a surfer may turn the surfboard towards or away from different parts of the cresting wave depending on the preference and skill of the surfer. Subsequently, the surfer must paddle out and repeat the process of catching and riding waves. After catching and riding waves for a period of time, the surfer may ride a wave all the way to the shoreline, or may "paddle in" by lying prone on the surfboard and paddling towards the shoreline. Paddling out, turning, and paddling quickly to catch waves can be tiring and time consuming to the surfer and can thus limit the surfer's energy and time for riding waves. Advantageous embodiments of the present invention preserve a surfer's maximum energy for riding waves rather than exhausting the surfer's energy on paddling. Advantageous embodiments of the present invention also assist in catching waves by providing additional speed to the surfer when catching a wave.

The general purpose of many embodiments described herein is to provide a motorized surfboard which can be manufactured in a less labor intensive manner, has minimal problems with leakage, and has long term reliability. In some advantageous embodiments, a motorized drive system is provided as a separately housed cassette. The cassette may house batteries, motors, control electronics, impellers and associated drive hardware. This design has many significant advantages. It simplifies the construction of the surfboard in which the cassette is used. It may be made removable and/or exchangeable. Such a cassette may also be used in a variety of watercraft, not just in surfboards. These features are described further below with respect to the cassette embodiments illustrated in FIGS. 10-19 below.

Figure 1:
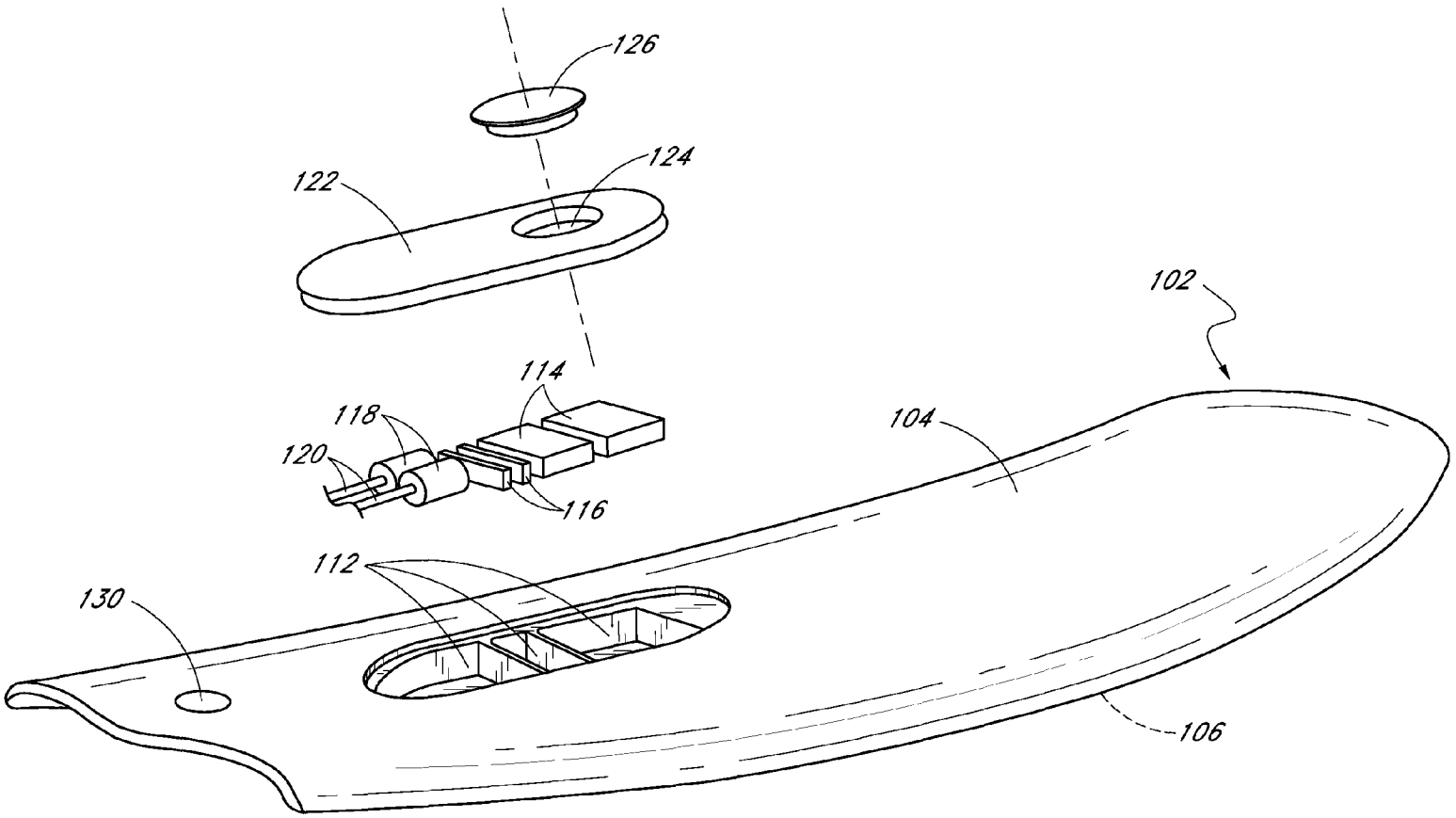
FIG. 1 is an exploded view of a top shell of a surfboard showing components placed in top shell recesses.
Figure 2:
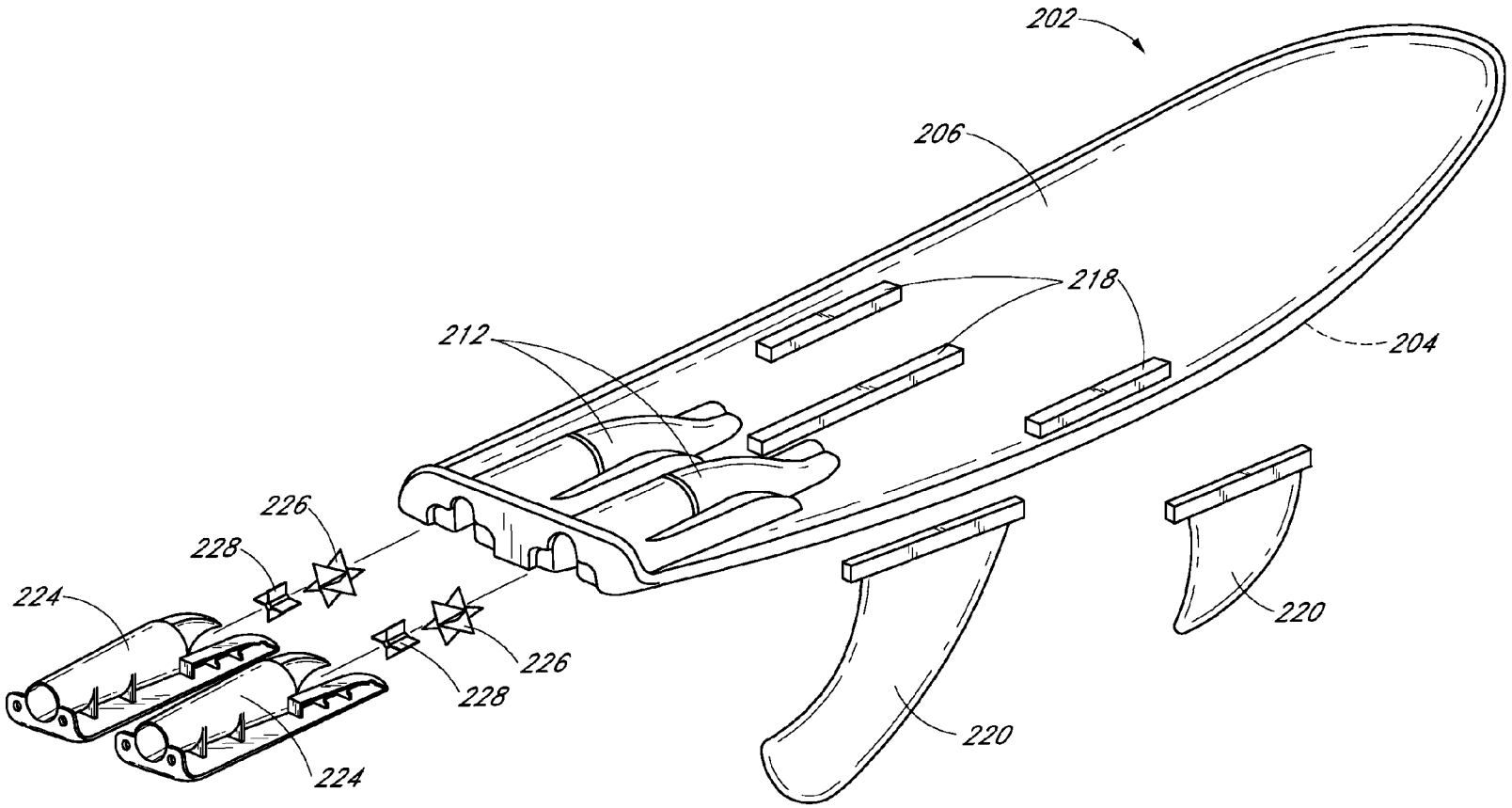
FIG. 2 is an exploded view of a bottom shell of a surfboard showing components placed in bottom shell recesses.
Figure 3:
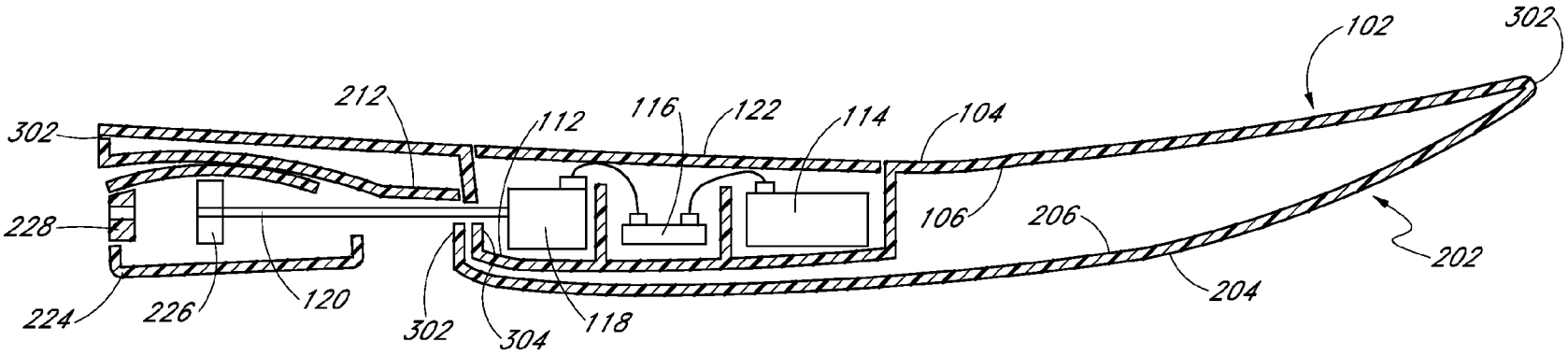
FIG. 3 is a cutaway view of a surfboard made from top and bottom shells with power components mounted therein in accordance with one embodiment of the invention.

FIGS. 1-6 illustrate suitable power and drive train components for a motorized watercraft such as a surfboard. In these Figures, the components are not placed in a cassette, but these Figures illustrate the components themselves and their relative placement and function. Referring now to FIGS. 1, 2, and 3, in some embodiments, a motorized surfboard comprises a top shell 102, and a bottom shell 202. This hollow shell construction has been recently utilized for surfboard manufacture, and represents a departure from traditional shaped foam boards. It is one aspect of the invention that this hollow shell design has been adapted to a motorized surfboard in a manner that minimizes manufacturing costs and provides structural integrity and long term reliability.

The top shell 102 is illustrated in FIG. 1, and the bottom shell 202 is illustrated in FIG. 2. In FIG. 3, a conceptual cutaway view is provided showing how the shells mate with each other in one embodiment.

The top shell 102 has an outer surface 104, and an inner surface 106. Similarly, the bottom shell has an outer surface 204, and an inner surface 206. To produce the complete surfboard body, the two shells are sealed together along a seam 302 that extends around the periphery of the top and bottom shells. The "outer surface" of the top and bottom shells are the surfaces that are contiguous with the surfaces exposed to the water in use (although not all of the "outer surface" of the shells is actually exposed to water as will be seen further below). The "inner surface" of the top and bottom shells are the surfaces internal to the hollow board after sealing into a hollow surfboard body. The general methods of producing surfboards with this hollow shell technique are known in the art. Currently, Aviso Surfboards (www.avisosurf.com) manufactures surfboards in this manner from carbon fiber top and bottom shells forming a hollow surfboard body.

The outer surface 104 of the top shell 102 is formed with one or more recessed portions 112, where the recessed portions extend generally toward the inner surface 206 of the bottom shell 202 when the shells are sealed together into a hollow body. The recessed portions 112 form compartments for batteries 114, motor controller boards 116, and motors 118. The motors 118 are coupled to shafts 120 that extend out the rear of the motor compartment as will be explained further below.

After installation of these components, the recesses can be sealed with a cover 122 that can be secured in place with adhesive such as caulking or other water resistant sealant. If desired, an internally threaded access port 124 can be provided that receives an externally threaded cover 126. This can provide easier access than removing or cutting the adhesive on the larger cover 122. In some advantageous embodiments, one or both of the covers 122, 126 are clear so that the batteries, motors, and/or other electronics can be seen when they surfboard is sealed up and in use. Another threaded plug 130 can also be provided, which can be used to ensure equal air pressures on the inside and outside of the hollow body. This feature is well known and normally utilized for hollow shell surfboards.

Turning now to FIG. 2, the outer surface 204 of the bottom shell 202 also includes one or more recessed portions 212, where the recessed portions extend generally toward the inner surface 106 of the top shell 102 when the shells are sealed together into a hollow surfboard body. The bottom shell 202 may also contain recesses 218 for fin boxes that accept fins 220 in a manner known in the art. The bottom shell recesses 212 are configured to accept pump housings 224. As shown in FIG. 3, the pump housings 224 receive the motor shafts 120, onto which an impeller 226 is attached. At the rear of the pump housing 224, a flow straightener 228 may be attached.

As shown in FIG. 3, the recessed portion 112 in the top shell and the recessed portion 212 in the bottom shell comprise walls 302 in the bottom shell and 304 in the top shell that are proximate to one another. In advantageous embodiments, these proximate walls extend approximately perpendicular to the overall top and bottom surfaces of the surfboard. In these proximate walls are substantially aligned openings, through which the motor shaft 120 extends. Thus, the motor(s) 118, which reside in a recessed portion of the top shell, are coupled to the impeller(s) that reside in the pump housing(s) that in turn reside in a recessed portion of the bottom shell.

Figure 4:
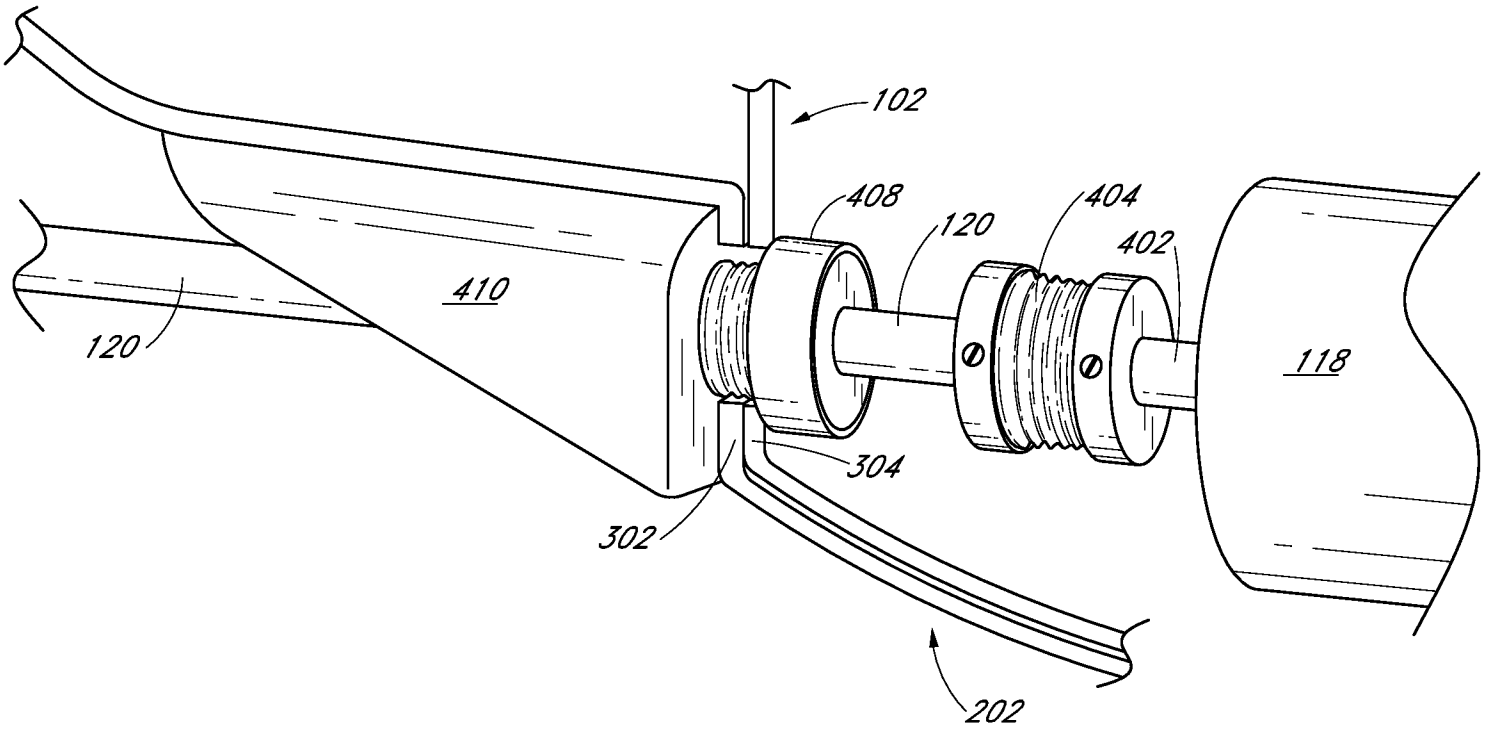
FIG. 4 shows a detailed view of a passageway between a motor recess in a top shell and an impeller recess in a bottom shell.

FIG. 4 illustrates in more detail the surfaces 302 and 304 through which the motor shaft 120 extends. Typically, the motor 118 includes an integral shaft 402 of fairly short extent. This short shaft may be coupled to a longer extended motor shaft 120 with a bellows coupler 404. These couplers 404 are commercially available, from for example, Ruland, as part number MBC-19-6-6-A. The bellows coupling 404 is advantageous because it allows for smooth shaft rotation even in the presence of vibrations and/or small deviations in linearity of the connection. The long shaft 120 then extends through a bearing 408 which has a threaded rear portion. The threaded rear portion of the bearing 408 is threaded into a threaded insert 410 that is positioned on the other side of the openings, in the recessed portion of the bottom shell. When the bearing is tightened into the insert, a water tight seal is created as the walls 302 and 304 are compressed together. It will be appreciated that the walls 302, 304 may directly touch, or they may remain separated, with or without additional material between. To further minimize any potential for leakage, it is possible to place washers of rubber, polymer, or the like between the insert 410 and the wall 320, and/or between the bearing 408 and the wall 304.

Figure 5:
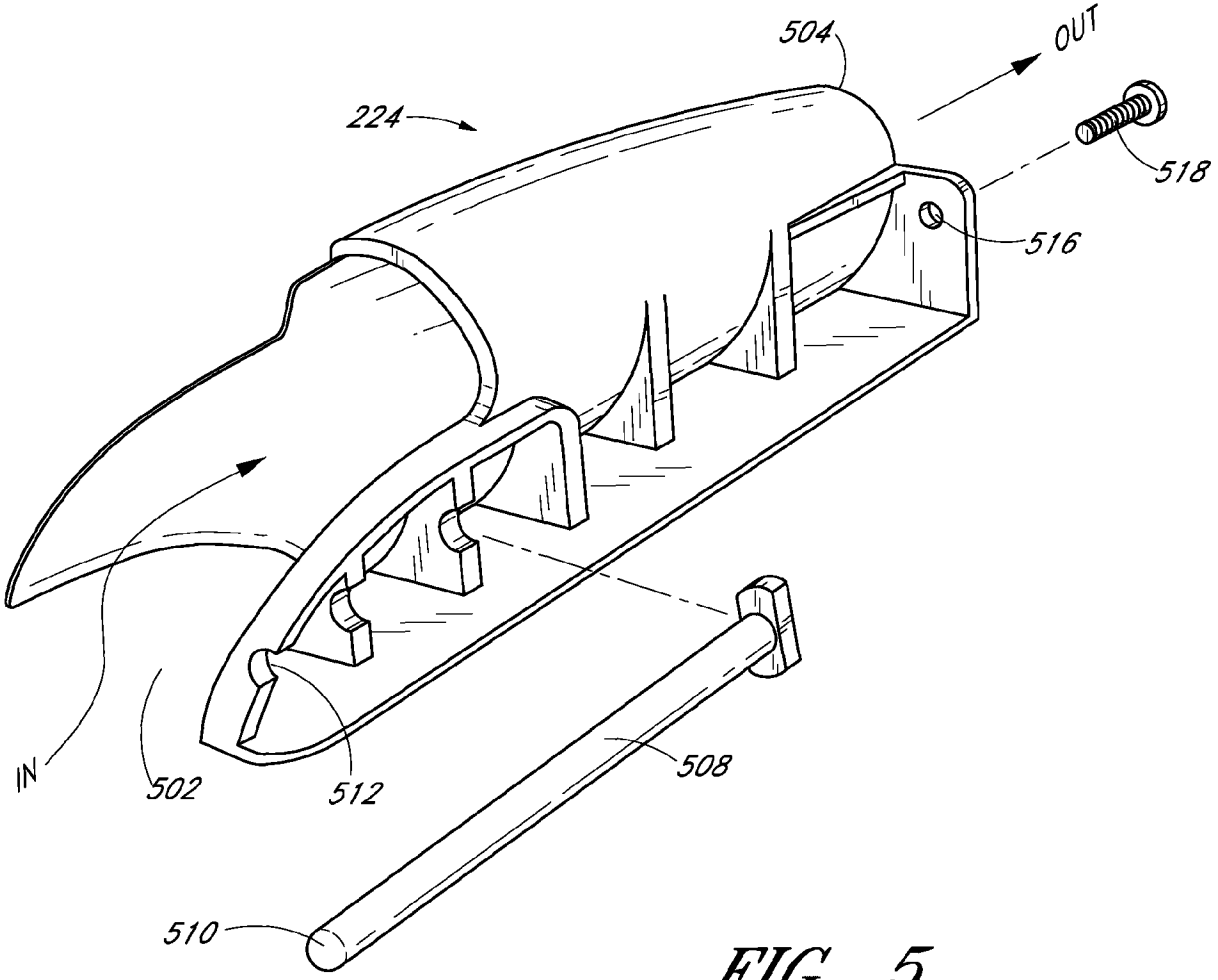
FIG. 5 is a perspective view of a flow housing in which the impeller may be inserted.
Figure 6:
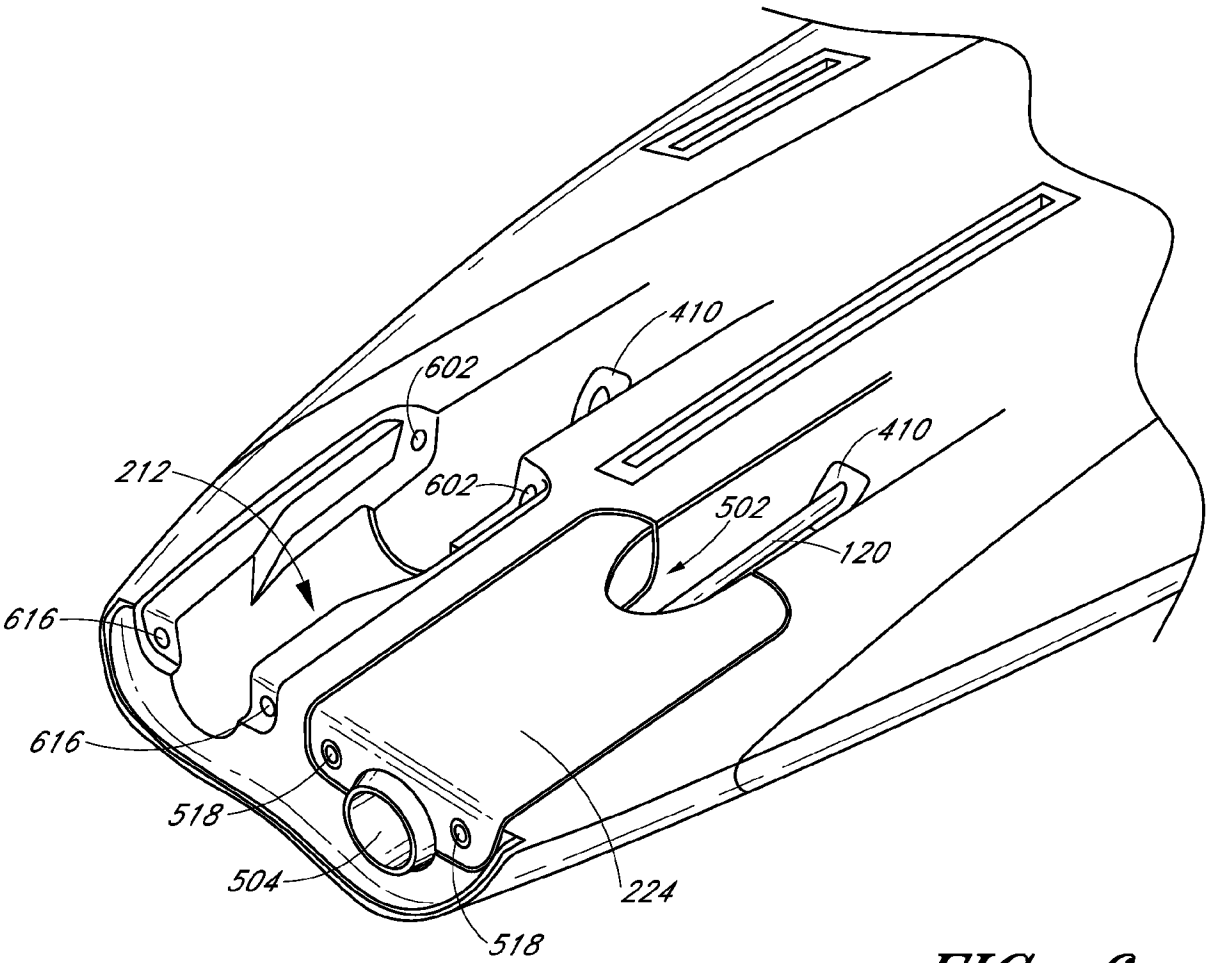
FIG. 6 illustrates the bottom shell attached to the top shell in the region of the surfboard tail with one flow housing attached in one of the bottom shell recesses.

FIGS. 5 and 6 illustrate the positioning of the pump housing 224 in the recessed portion 212 of the bottom shell. FIG. 5 illustrates the underside of the pump housing 224 and FIG. 6 illustrates a pump housing installed in a recess of the bottom shell. The pump housing 224 is basically a hollow tube for directing water up to the impeller and out the rear of the surfboard. Thus, the pump housing comprises an inlet port 502 and an exhaust port 504. The pump housing 224 can be secured in the recess 212 in a variety of ways. The embodiment of FIGS. 5 and 6 includes shafts 508 that are secured to each side of the pump housing. The tip 510 of the shaft 508 extends through an opening 512 in the frontward of the pump housing 224. Referring now to FIG. 6, these exposed tips 510 are placed in holes 602 in the recess to secure the pump housing into the frontward portion of the recess 212. The rear of the pump housing may comprise a wall with holes that mate with holes 616 in the bottom shell. The holes in the bottom shell may be provided with press fit threaded inserts. Screws 518 can then be used to secure the rear of the pump housing 224 to the rear of the recess 212.

It will be appreciated that the pump housing 224 can be secured in the recess 212 in a variety of ways. For example, instead of having holes in the bottom shell for screws and pins, slots and/or blind recesses can be formed in or adhesively attached to the side surfaces of the recess that engage mating surfaces on the pump housing. Such structures can also be provided with threads for engaging screw connections. As another alternative, adhesive could be used to secure the pump housing in place.

Turning now to the power and control electronics and devices illustrated in FIGS. 1 and 3, a wide variety of power sources, motor controllers, and motors may be utilized. They can be secured in their respective recesses on metal frames and/or plates (not shown) that are secured in the recesses with adhesive and/or with fasteners such as screws to structures in the recesses integral to the side walls or adhesively secured thereto. Acceptable sources of power include a lithium battery or plurality of lithium batteries.

To avoid a hard wired connection to the motor controllers 116 from a throttle control input, the motor controller 116 advantageously include a wireless receiver. This receiver can communicate with a wireless transmitter that is controlled by the surfer in order to control the motor speed. Wireless throttle controls have been used extensively, but using a throttle while surfing poses unique issues in that paddling, standing, and riding waves will interfere with a surfer's ability to easily manipulate a control mechanism such as a trigger, a dial, or the like. In one embodiment, wireless transmission circuitry can be configured to transmit electromagnetic and/or magnetic signals underwater. Because one or both transmitter and receiver can be under the surface of the ocean during much of the duration of surfing, a transmission system and protocol that is especially reliable in these conditions may be used. For example, wireless circuitry can be implemented in accordance with the systems and methods disclosed in U.S. Pat. No. 7,711,322, which is hereby incorporated by reference in its entirety. As explained in this patent, it can be useful to use a magnetically coupled antenna operating in a near field regime. A low frequency signal, e.g. less than 1 MHz, can further improve underwater transmission reliability. With this type of throttle system, an automatic shut off may be implemented, where if the signal strength between the transmitter and receiver drops below a certain threshold, indicating a certain distance between the two has been exceeded, the receiver shuts off the electric motor. This is useful as an automatic shut off if the surfer falls off the board.

Figure 7:
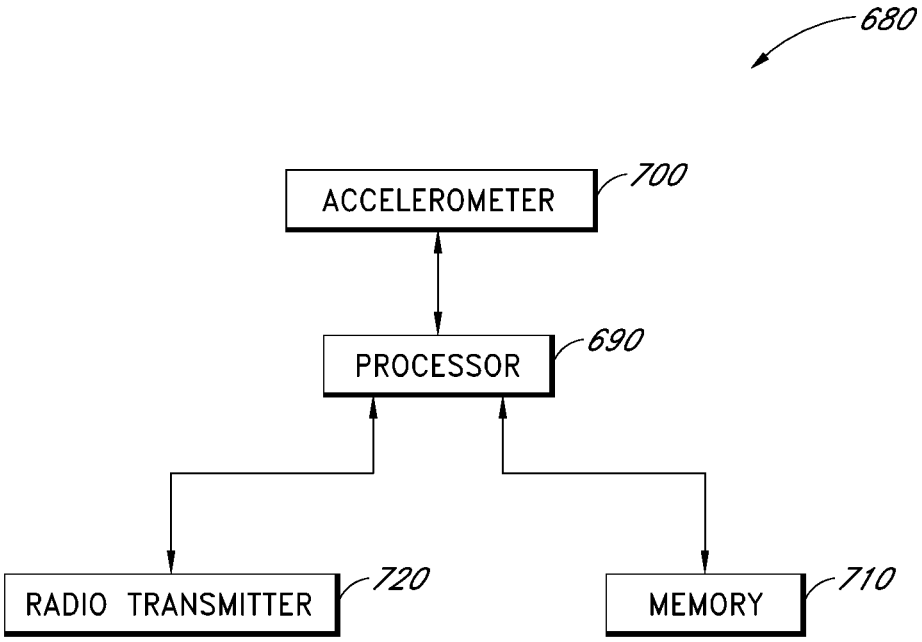
FIG. 7 is a block drawing showing one embodiment of a drive control system, which may be used in one embodiment of the motorized surfboard.

FIG. 7 illustrates an alternative control mechanism 680 for controlling a motorized surfboard. Control mechanism 680 has a processor 690 for coordinating the operation of the control mechanism 680. The processor 690 is coupled to an accelerometer 700. The accelerometer 700 measures acceleration. These measurements are communicated to processor 690. Processor 690 may also communicate with accelerometer 700 for the purpose of initializing or calibrating accelerometer 700. In one embodiment, accelerometer 700 is a 3-axis accelerometer and can measure acceleration in any direction. Processor 690 is also coupled to memory 710. In one example, memory 710 is used to store patterns or profiles of accelerometer readings which have been associated with particular motor control commands. For example, memory 710 may store a pattern of accelerometer readings which has been previously associated with a command to cause the motor controller to activate the motors. The processor 690 can compare the current accelerometer 700 outputs to the previously stored profiles to determine whether the current outputs should be interpreted as a motor command. Control mechanism 680 also has a radio transmitter 720 coupled to the processor 690. In one embodiment, radio transmitter 720 transmits information received from processor 690, such as motor commands, to radio receiver 504.

Figure 8:
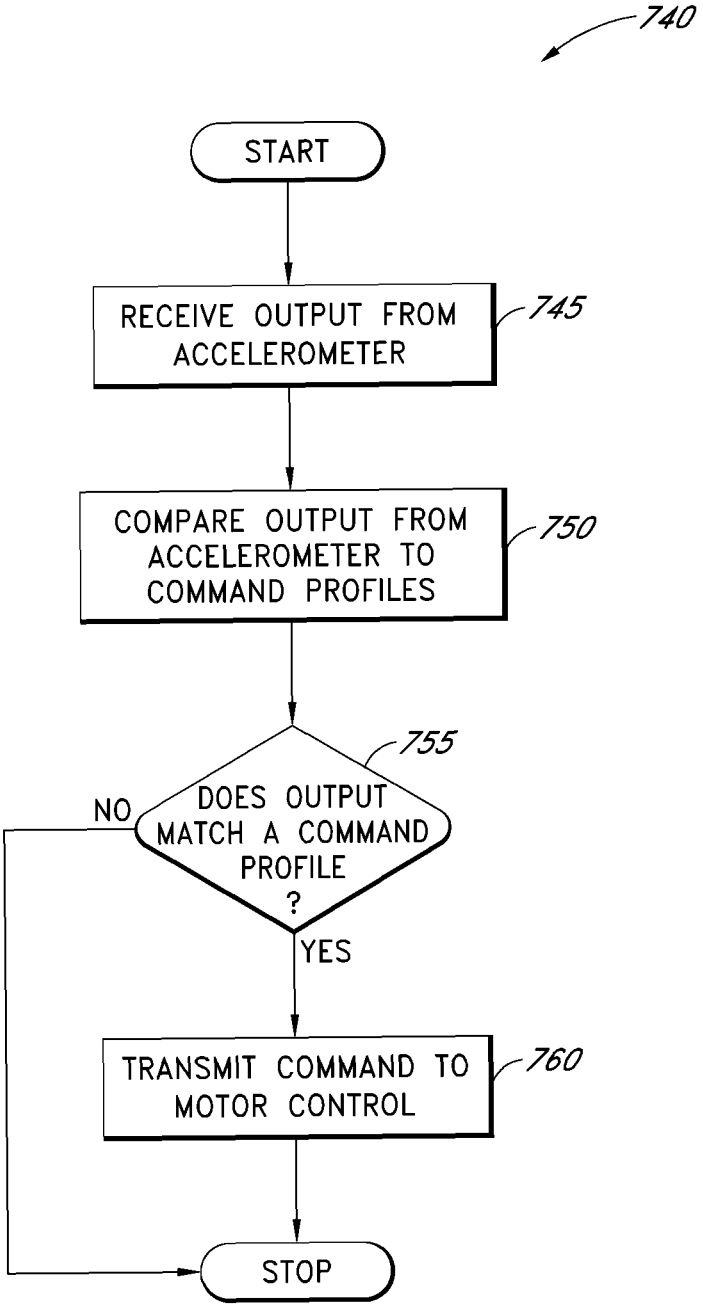
FIG. 8 is a flow chart illustrating a method for use with one embodiment of the motorized surfboard.

FIG. 8 illustrates a method 740 for using control mechanism 680, consistent with one embodiment of the invention. At step 745, output is received from the accelerometer. In one embodiment, the output from the accelerometer may be an analog signal representative of the acceleration measured along each axis measured by the accelerometer. In another embodiment, an analog to digital converter may be used to convert the output to a digital representation of the analog signal. Alternatively, the accelerometer may be configured to output digital signals. For example, the accelerometer itself may be configured to output a digital pulse when the acceleration detected on each axis exceeds some threshold amount.

After the output from the accelerometer is received, the control mechanism compares the output to pre-determined command profiles as show in step 750. These command profiles may also be referred to as accelerometer output patterns or simply as patterns. For example, the control mechanism may store a pattern corresponding to a repeated positive and negative acceleration substantially along a particular axis. Another pattern may correspond to an isolated positive acceleration along a particular axis. The patterns of accelerometer outputs may be associated with particular commands for the motor controllers. For example one pattern may correspond to a command to activate a subset of the available motors. Another pattern may correspond to a command to activate one or more available motors with a particular duty cycle or at a particular percentage of maximum operation potential.

The comparison of the current accelerometer output to the command profile results in a determination of whether the output matches a particular command profile, as shown in step 755. In one embodiment, if the current output does not match a command profile, the output from the accelerometer is discarded and the method concludes, leaving the control mechanism to wait for more output from the accelerometer. However, if the current output does match a command profile, the control mechanism transmits the corresponding command to the motor controllers, as shown in step 760. After the transmission, the command mechanism may again wait for additional output from the accelerometer.

Figure 9:
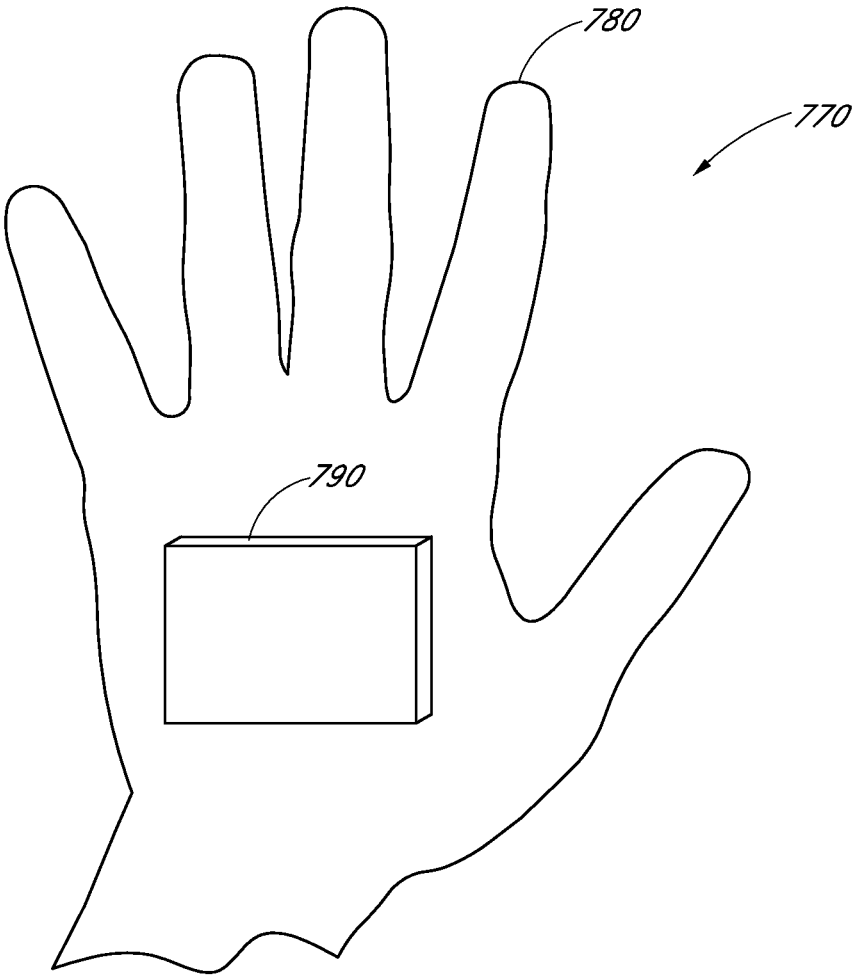
FIG. 9 is a flow a top view of one embodiment of a drive control system, which may be used in one embodiment of the motorized surfboard.

In alternative embodiments, the control mechanism may operate without the need for pattern comparison. For example, in one embodiment, the control mechanism may be configured to interpret accelerometer readings as a proxy for throttle control. In one embodiment, the magnitude and duration of the accelerometer output may be directly translated into magnitude and duration signals for the motor controllers. For example, an acceleration reading above a particular threshold may be interpreted as a command to activate the motors. The duration of the command may be a proportional to the duration for which the acceleration reading is received. FIG. 9 illustrates one possible embodiment for the control mechanism 680. In this embodiment the control mechanism is encapsulated in a package 790 which is integrated into a glove 780. It will be appreciated by one of ordinary skill in the art that the term integrated into the glove may comprise being attached to the surface or within the structure of glove 780. In one embodiment the package 790 is a water tight package. In one embodiment, package 790 comprises a plastic box. In another embodiment, package 790 comprises layers of fabric or other materials. Advantageously this embodiment facilitates control of the motorized surfboard while maintaining the ability of the surfer to use his hands for normal surfing activity. For example, rather than positioning one hand on throttle 620 to control the motorized surfboard, the normal motion of the surfer's hand, while wearing the glove, may be used to control the motorized surfboard. For example, it may be desirable for the motor controller to activate the motors while the surfer would normally be paddling. This may be when the surfer is paddling out or when the surfer is attempting to position himself to catch a wave. Accordingly, when the control mechanism is embedded in a glove 780, the control mechanism may be configured to recognize the acceleration experienced by a surfer's hand during the paddling motion as a command to engage the motors. Thus, the surfer is free to use his hands for normal surfing activity while the control mechanism activates the motors when the surfer's hand motions indicate that the surfer is performing an activity which would be aided by additional motor support. Alternatively, the control mechanism may be configured to activate the motors in response to patterns which, though not necessarily surfing related, require less effort or distraction than involved in manually manipulating a throttle. For example, while riding a wave, rather than adjusting a throttle, the surfer wearing glove 780 might simply shake his hand to engage or disengage the motor. Accordingly, the surfer is able to control the motors of the surfboard with less effort and coordination than would be required to manipulate the throttle embedded in body of the surfboard. In an alternative embodiment, the packaged control mechanism 790 may also be attached to or integrated into a wrist strap of other clothing or accessory. In another embodiment, a glove 780 or other accessory or clothing may be worn on each hand and each corresponding control mechanism may control a different subset of motors in the motorized surfboard.

Figure 10:
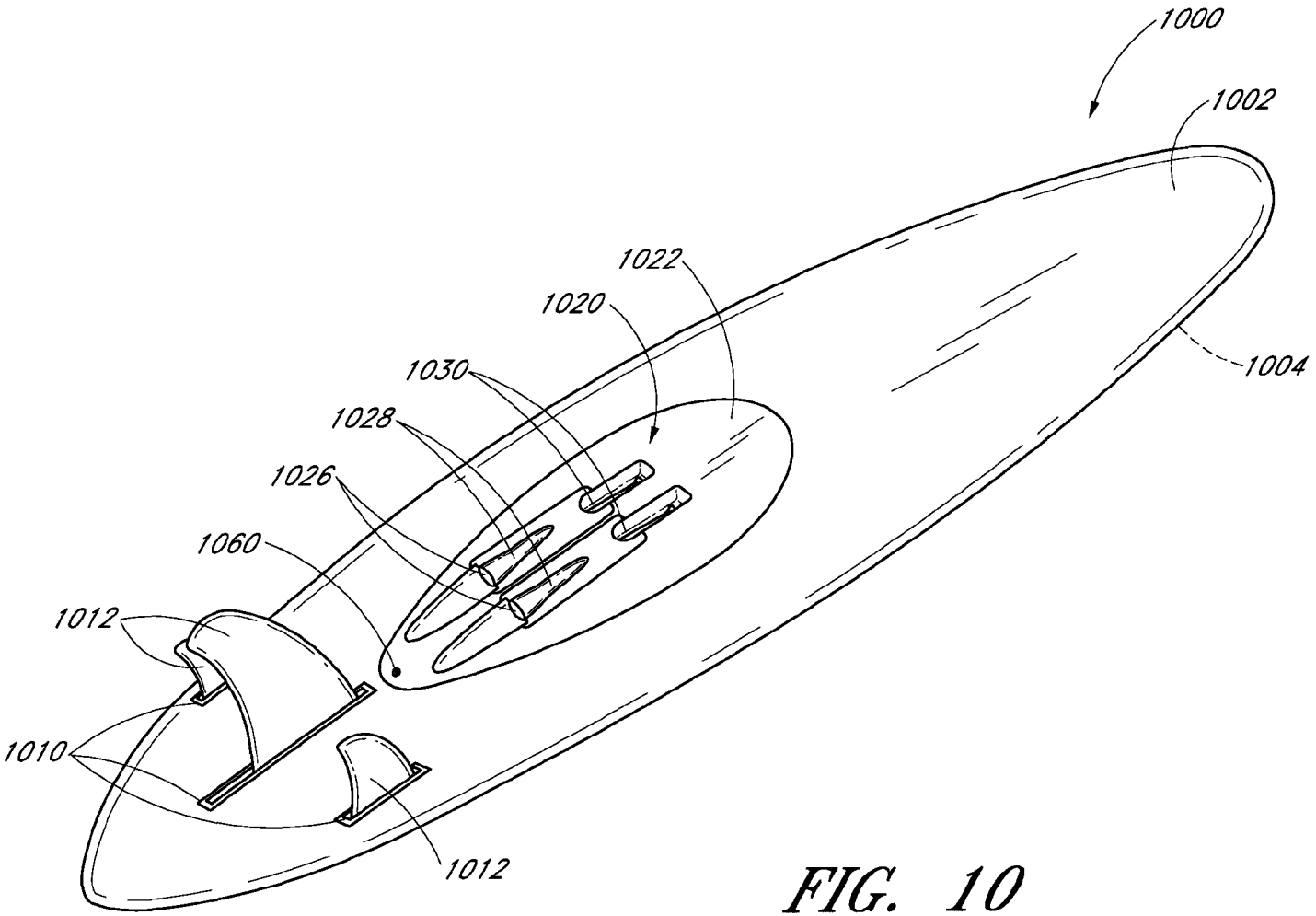
FIG. 10 is a perspective view of a personal watercraft including a first embodiment of a motorized cassette received in a bottom recess of the personal watercraft.
Figure 11:
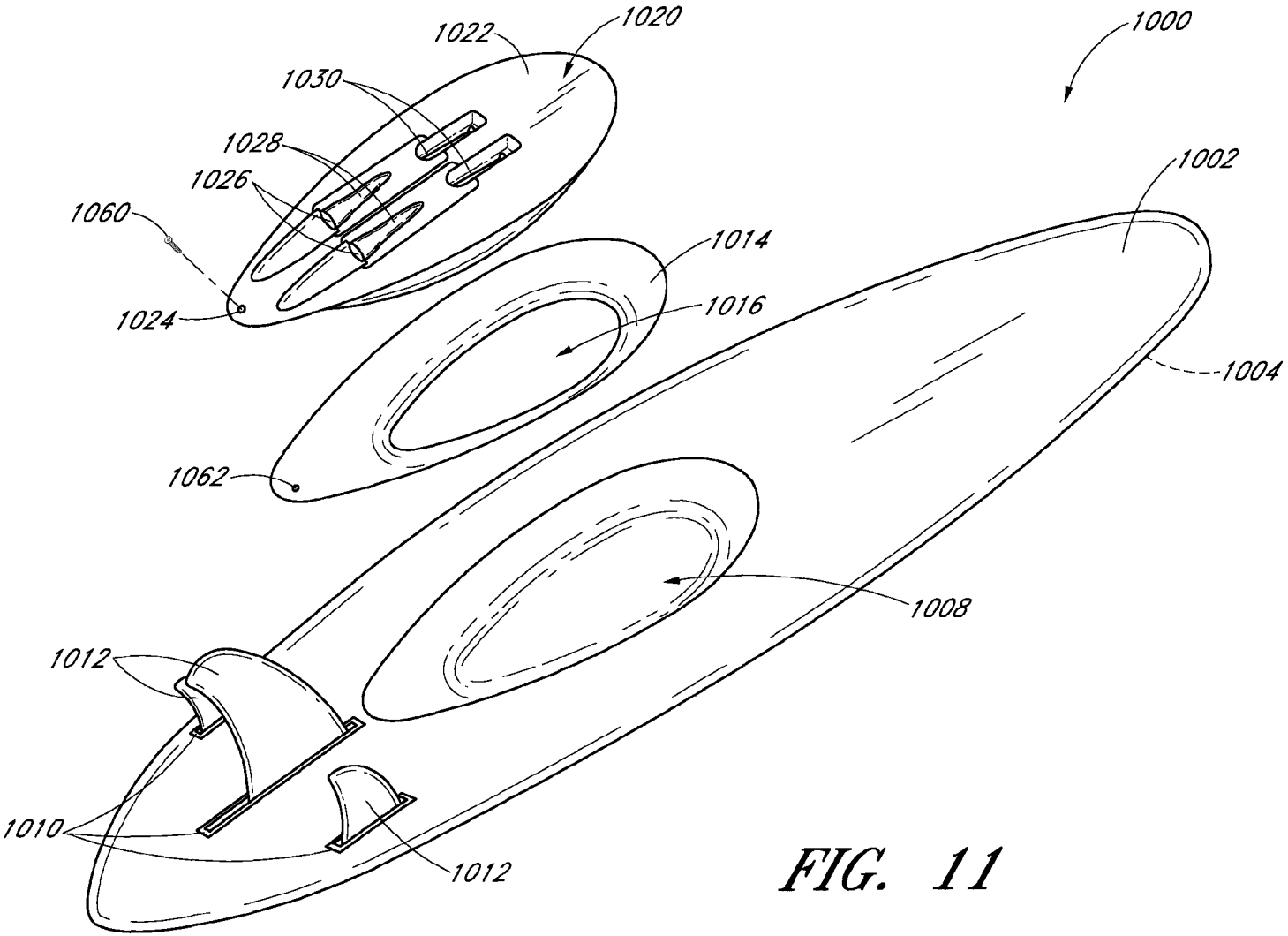
FIG. 11 is an exploded view of the surfboard of FIG. 10.

Turning now to FIGS. 10 and 11, a personal watercraft comprising a first embodiment of a motorized cassette 1020 and a watercraft body 1000 is shown. The body 1000 comprises a top side 1004 and a bottom side 1002. In some embodiments, the body 1000 may comprise a surfboard and in other embodiments the body 1000 may comprise other traditionally non-powered watercrafts including, for example, inflatable watercrafts, dinghies, life rafts, tenders, sail boards, stand up paddle boards ("SUP boards"), kayaks, and canoes. The body 1000 may be constructed by affixing a top shell to a bottom shell as discussed above or may be constructed using other various methods known to those having ordinary skill in the art. The body 1000 may optionally comprise one or more fin boxes 1010 configured to receive one or more fins 1012.

Turning now also to FIG. 11, the bottom side 1002 of the body 1000 may comprise a recess 1008 configured to receive a cassette 1020 therein. The recess 1008 may extend from the bottom surface 1002 toward the top surface 1004 and comprise a generally convex shaped depression in the bottom surface 1002 of the body 1000. In one embodiment, the recess 1008 forms a tear-drop shaped aperture in the bottom surface 1002. The tear-drop shaped aperture may be complimentary to the shapes of an insert 1014 and/or cassette 1020 such that the insert 1014 and/or cassette 1020 can be oriented and/or positioned in a desired configuration within the recess 1008. As explained in further detail below, the insert can be useful because it can include desired features such as flanges, threaded holes for fastener engagement, and the like that can be used to, among other things, secure the cassette in the recess of the surfboard. This allows the shell of the surfboard itself to be entirely made with smooth and gently rounded surfaces in and around the recess 1008 and without sharp corners, holes, or other features that require difficult manufacturing processes. This makes the production of the surfboard 1000 itself very easy and requires minimal changes to the process of manufacturing a conventional surfboard.

With continued reference to FIG. 11, the insert 1014 may comprise a solid or substantially ring-shaped sheet structure configured to cover at least a portion of the recess 1008. The insert 1014 may be coupled to the recess 1008 using various coupling means, for example, adhesives, bonding agents, and/or fasteners. In some embodiments, by virtue of the complimentary shapes of the insert 1014 and the recess 1008, the insert 1014 may be form fitted within the recess 1008 such that the engagement therebetween inhibits longitudinal, lateral, and/or transverse motion of the insert 1014 relative to the recess 1008. When disposed within the recess 1008, the insert 1014 can define a receiving space 1016 for receiving the cassette 1020. In some embodiments, the insert 1014 may comprise one or more relatively small flanges or protrusions (not shown) extending into the receiving space 1016. The one or more flanges can be configured to engage one or more mating grooves (not shown) disposed in the cassette 1020. In one embodiment, a flange extends from a forward most portion of the insert 1014 into the receiving space 1016 and the forward most portion of the cassette 1020 includes a corresponding groove. In this way, the cassette 1020 may releasably engage the insert 1014 to align and hold the front of the cassette 1020 relative to the insert 1014 and body 1000. As shown in FIG. 10, the base surface 1022 of the cassette 1020 may be configured to substantially match the adjacent base surface 1002 of the body 1000 to achieve a desired hydrodynamic profile of the personal watercraft.

The cassette 1020 may be releasably coupled to the insert 1014 and recess 1008 by one or more fasteners 1060. In one embodiment, the insert 1014 includes an internally threaded bore 1062 configured to threadably engage a portion of a threaded fastener 1060, for example, a screw, that passes through a corresponding aperture 1024 formed in the cassette 1020. In another embodiment, a threaded bore is disposed in the body 1000 and configured to engage a portion of threaded fastener 1060. In one embodiment, a groove on a first end of the cassette 1020 may releasably receive at least a portion of a corresponding flange extending from the insert 1014 and the second end of the cassette 1020 may be fastened to the insert/body by fastener 1060 to restrict longitudinal, lateral, and/or transverse motion of the cassette 1020 relative to the recess 1008. As discussed in more detail below, the receiving space 1016 may be configured to releasably receive various different cassettes that are similarly shaped to cassette 1020.

As shown in FIGS. 10 and 11, the removable cassette 1020 may comprise a drive system for the personal watercraft. In one embodiment, the drive system components disclosed with reference to FIGS. 1-6 may be housed within the cassette 1020. For example, cassette 1020 may comprise one or more exhaust ports 1026, one or more pump housings 1028, one or more motor shafts 1030, one or more motors (not shown), one or more batteries (not shown), and/or one or more impellers (not shown). The orientation and design of these components may be basically the same as described above but housed within cassette 1020. Thus, cassette 1020 may propel the body 1000 relative to a body of water, for example, to aid in paddling out a surfboard and catching waves.

Figure 12:
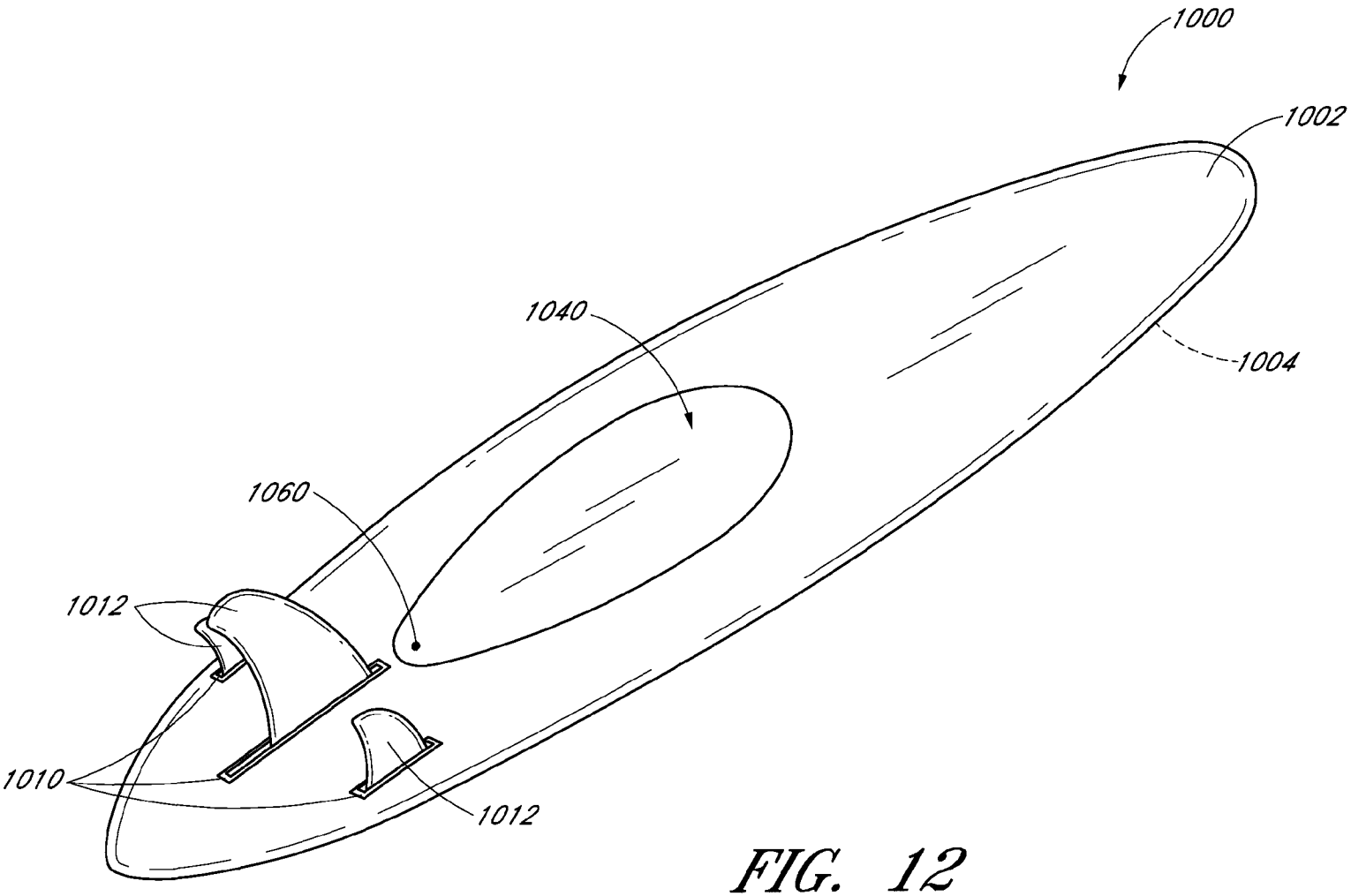
FIG. 12 is a perspective view of the personal watercraft of FIGS. 10 and 11 including a non-motorized cassette received in a bottom recess of the personal watercraft.
Figure 13:
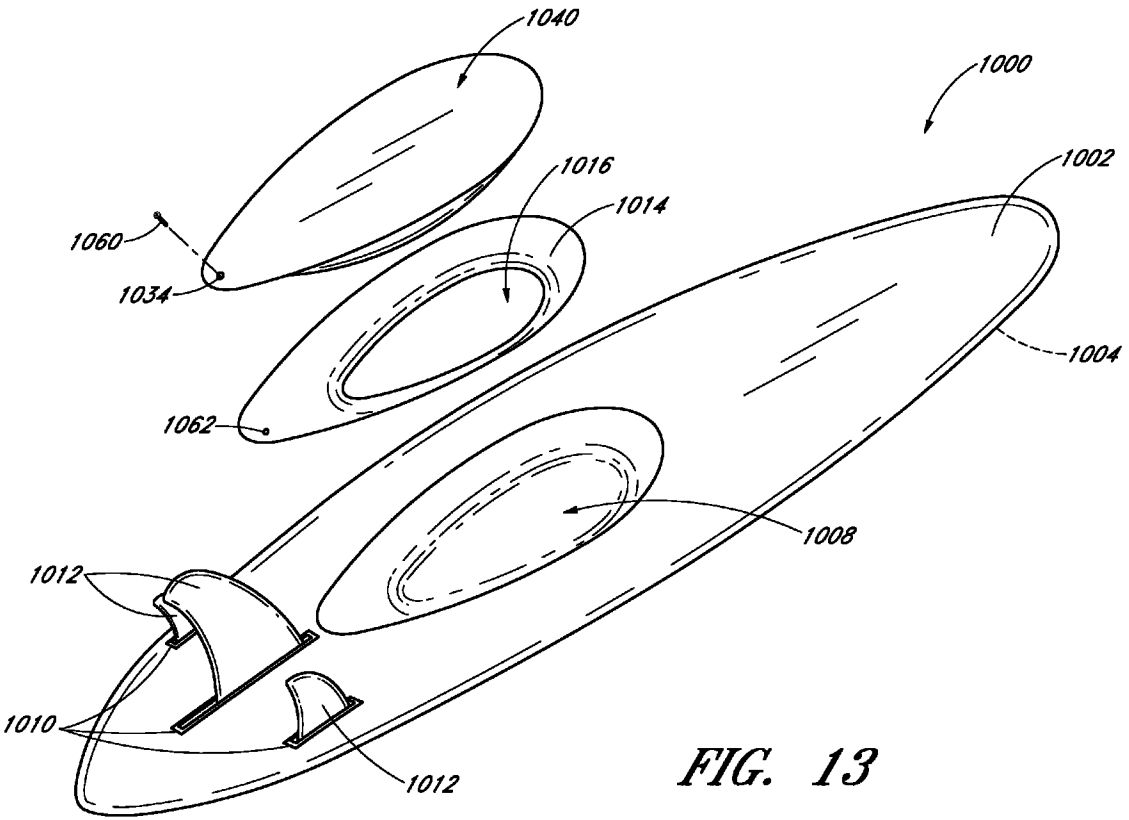
FIG. 13 is an exploded view of the surfboard of FIG. 12.

FIGS. 12 and 13 show the personal watercraft comprising a second embodiment of a cassette 1040 received within body 1000. Cassette 1040 may be similarly shaped to cassette 1020 of FIGS. 10 and 11 such that both cassettes fit tightly within the receiving space 1016 formed by insert 1014. Cassette 1040 may be releasably coupled to the body 1000 by one or more threaded fasteners 1060 and/or the engagement between a flange extending from the insert and a groove in the cassette 1040. As shown, fastener 1060 may pass through an aperture 1034 in the cassette 1040 and be received within threaded bore 1062 in insert 1014.

In contrast to cassette 1020 of FIGS. 10 and 11, cassette 1040 may be un-powered or non-motorized. In some embodiments, the cassette 1040 may be hollow and may enclose a storage space configured to store personal items, for example, sun screen, watercraft hardware, keys, mobile phones, etc. In one embodiment, the storage space may be substantially water tight to protect items stored therein from the ingress of water from a body of water, for example, the ocean. In other embodiments, the cassette 1040 may be substantially solid such that the watercraft has generally uniform buoyancy and/or rigidity characteristics from the front end to the back end.

The cassette 1020 of FIGS. 10 and 11 and the cassette 1040 of FIGS. 12 and 13 may be interchanged to convert the body 1000 between a motorized configuration (FIGS. 10 and 11) and a non-motorized configuration (FIGS. 12 and 13). The body 1000 may come as a kit with one or both of the motorized cassette 1020 and the non-motorized cassette 1040. A user may switch between cassettes 1020 and 1040 depending on water conditions and/or desired performance characteristics of the personal watercraft. For example, a user may wish to lower the overall mass characteristic of the personal watercraft by opting to place the non-motorized cassette 1040 within the body 1000 or a user may wish to minimize human energy used in a surf session by opting to place the motorized cassette 1020 within the body 1000.

Figure 14:
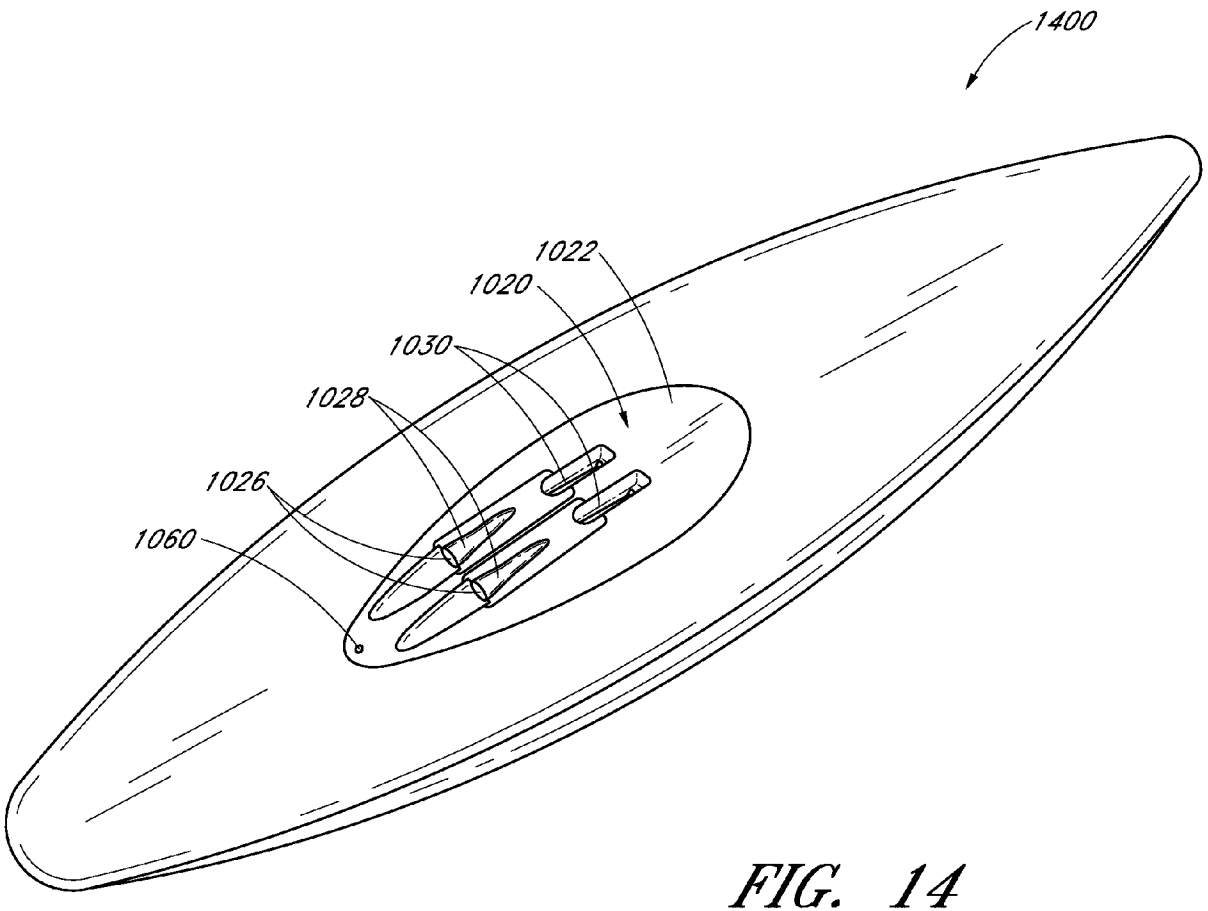
FIG. 14 is a perspective view of a kayak including the first embodiment of a cassette received in a bottom recess of the kayak.
Figure 15:
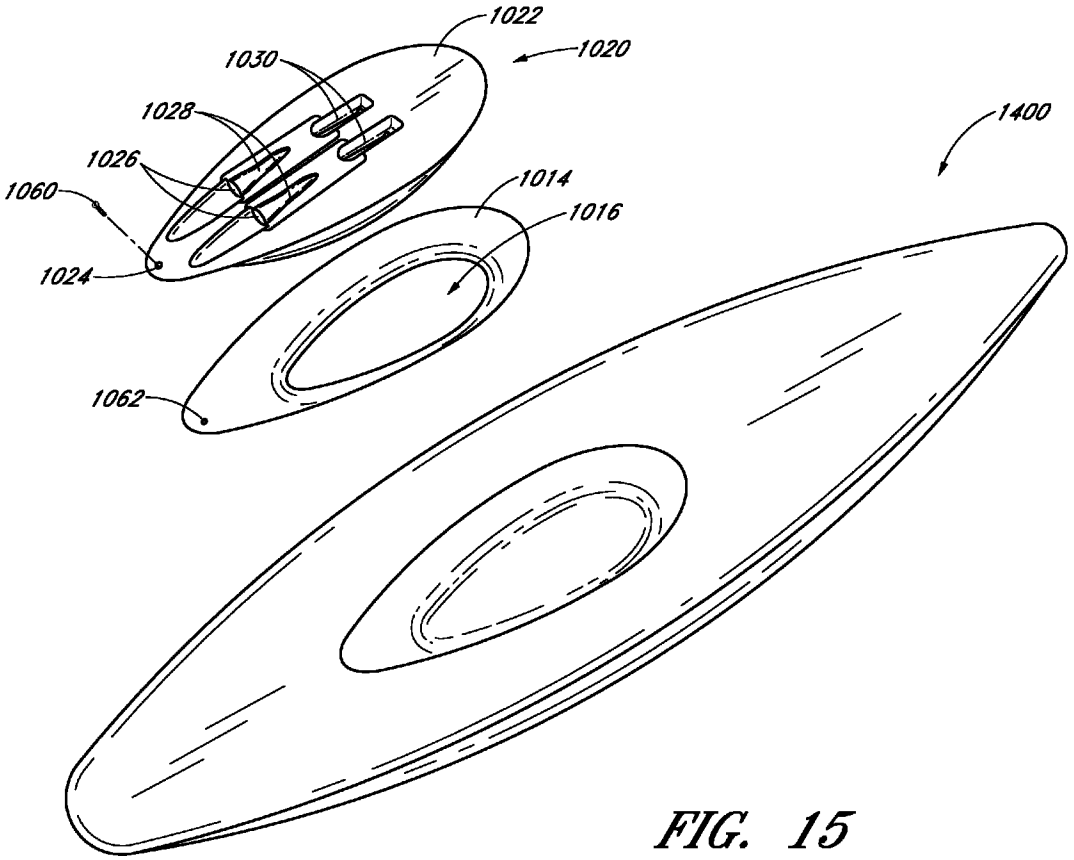
FIG. 15 is an exploded view of the kayak of FIG. 14.

FIGS. 14 and 15 show a kayak including the cassette 1020 and insert 1014 of FIGS. 10 and 11 received within a recess 1408 of the kayak body 1400. As shown, a single cassette (e.g., cassette 1020 of FIGS. 10 and 11 or cassette 1040 of FIGS. 12 and 13) may be placed in different watercraft bodies that have recesses configured to receive the cassette. For example, a motorized cassette 1020 can be configured to fit within a recess in the body of a surfboard and a similarly shaped recess in the body of a kayak such that a user may use the same motorized cassette in multiple watercrafts. In this way, a user may purchase a single motorized cassette to propel different watercrafts. Further, in some implementations, a motorized cassette may be used as a stand alone device to propel a user without a watercraft. For example, a user may hold a motorized cassette 1020 and be propelled through a body of water without a more substantial watercraft (e.g., without a surf board or kayak).

Figure 16:
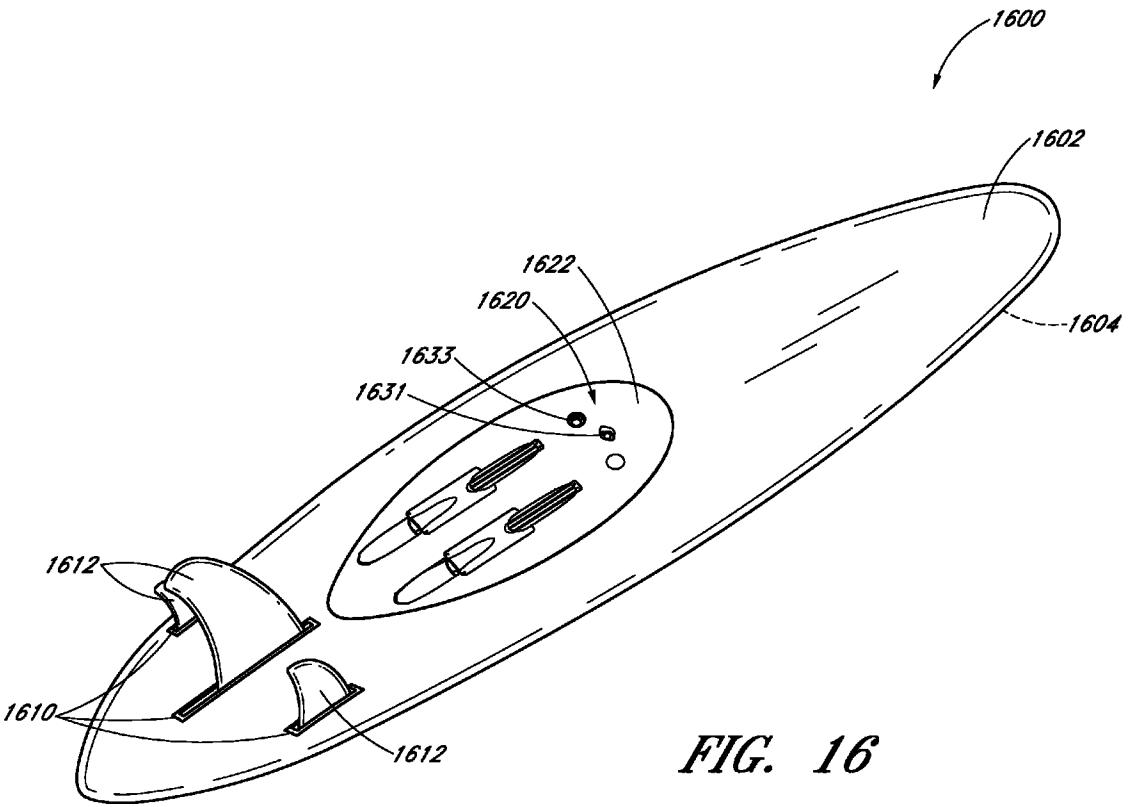
FIG. 16 is a perspective view of a personal watercraft including a second embodiment of a motorized cassette received in a bottom recess of the personal watercraft.
Figure 17:
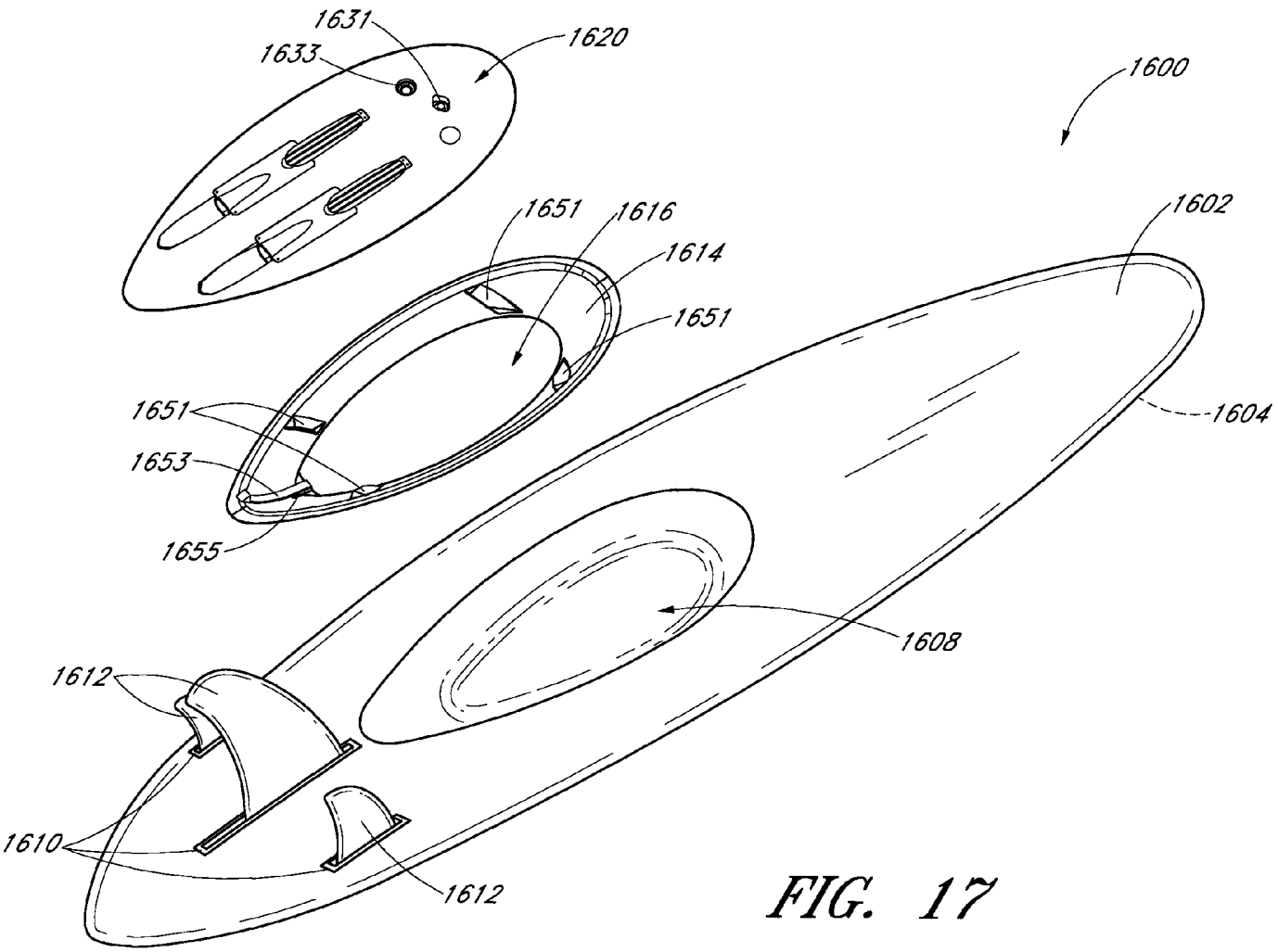
FIG. 17 is an exploded view of the surfboard of FIG. 16.

Turning now to FIGS. 16 and 17, a personal watercraft comprising a motorized cassette 1620 and a watercraft body 1600 is shown. The body 1600 comprises a top side 1604 and a bottom side 1602. In some embodiments, the body 1600 may comprise a surfboard and in other embodiments the body 1600 may comprise other various watercrafts. Similar to the personal watercraft of FIGS. 10-13, the body 1600 may be constructed by affixing a top shell to a bottom shell as discussed above or may be constructed using other various methods known to those having ordinary skill in the art. The body 1600 may optionally comprise one or more fin boxes 1610 configured to receive one or more fins 1612.

Turning now to FIG. 17, the bottom side 1602 of the body 1600 may comprise a recess 1608 configured to receive a cassette 1620 therein. The recess 1608 may extend from the bottom surface 1602 toward the top surface 1604 and comprise a generally convex shaped depression in the bottom surface 1602 of the body 1600. In one embodiment, the recess 1608 forms a tear-drop shaped aperture in the bottom surface 1602. The tear-drop shaped aperture may be complimentary to the shapes of the insert 1614 and/or cassette 1620 such that the insert 1614 and/or cassette 1620 can be oriented and/or positioned in a desired configuration within the recess 1608.

With continued reference to FIG. 17, the insert 1614 may comprise a solid or substantially ring-shaped sheet structure configured to cover at least a portion of the recess 1608. The insert 1614 may be coupled to the recess 1608 using various coupling means, for example, adhesives, bonding agents, and/or fasteners. In some embodiments, by virtue of the complimentary shapes of the insert 1614 and the recess 1608, the insert 1614 may be form fitted within the recess 1608 such that the engagement therebetween inhibits longitudinal, lateral, and/or transverse motion of the insert 1614 relative to the recess 1608. When disposed within the recess 1608, the insert 1614 can define a receiving space 1616 for receiving the cassette 1620.

In some embodiments, the insert 1614 may include one or more protrusions 1651 configured to be inserted into one or more indentations 1659 (shown in FIG. 18) on the cassette 1620. The protrusions 1651 and indentations 1659 on the cassette 1620 can have complimentary shapes such that the protrusions may be received by the indentations by sliding the cassette 1620 forward longitudinally relative to the insert 1614. The engagement of the protrusions 1651 and corresponding indentations can result in one or more abutments that act to arrest or inhibit longitudinal, lateral, and/or transverse movement of the cassette 1620 relative to the insert 1614 and body 1600.

The insert 1614 may also include a latch element 1653 that is cantilevered from a latch plate 1655. The latch element 1653 may catch one or more surfaces within a receptacle 1661 (shown in FIG. 18) on the cassette 1620 when the cassette 1620 is received within the insert 1614 to secure the cassette 1620 in the longitudinal direction relative to the insert 1614. In this way, the cassette 1620 may be slid forward into the insert 1614 until the latch 1653 releasably engages a notch or other feature on the cassette such that the cassette 1620 is aligned and secured relative to the insert 1614. To remove the cassette 1620 from the insert 1614, the latch element 1653 may be depressed by applying a force to the cantilevered end of the latch element 1653 to disengage the latch element from the notch or other feature of the cassette. Disengaging the latch element 1653 then will allow a user to slide the cassette 1620 backward longitudinally relative to the insert 1614 to release the protrusions 1651 from the indentations 1659 and to remove the cassette 1620 from the body 1600.

As shown in FIG. 16, the base surface 1622 of the cassette 1620 may be configured to substantially match the adjacent base surface 1602 of the body 1600 to achieve a desired hydrodynamic profile of the personal watercraft. The base surface 1622 may also include a charging port 1631 and/or activation switch 1633. Thus, the cassette 1620 may be charged when the cassette is coupled to the watercraft body 1600 or when it is separate from the watercraft body. In embodiments when these are provided, the charger port 1631 can be disposed on an opposite side of the cassette 1620 and the activation switch 1633 can be disposed elsewhere as well if desired.

Figure 18:
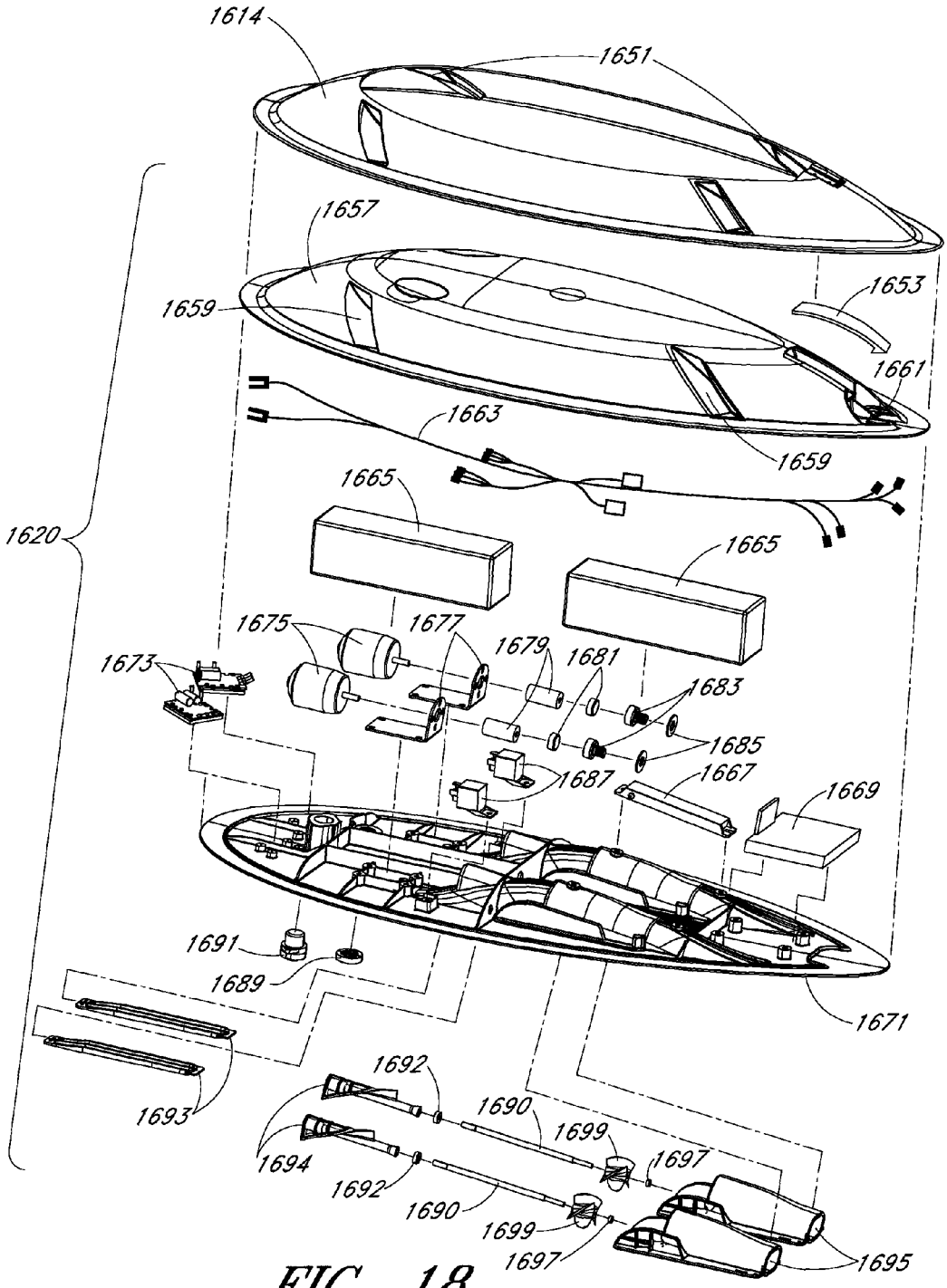
FIG. 18 is an exploded view of the motorized cassette of FIGS. 16 and 17.
Figure 19:
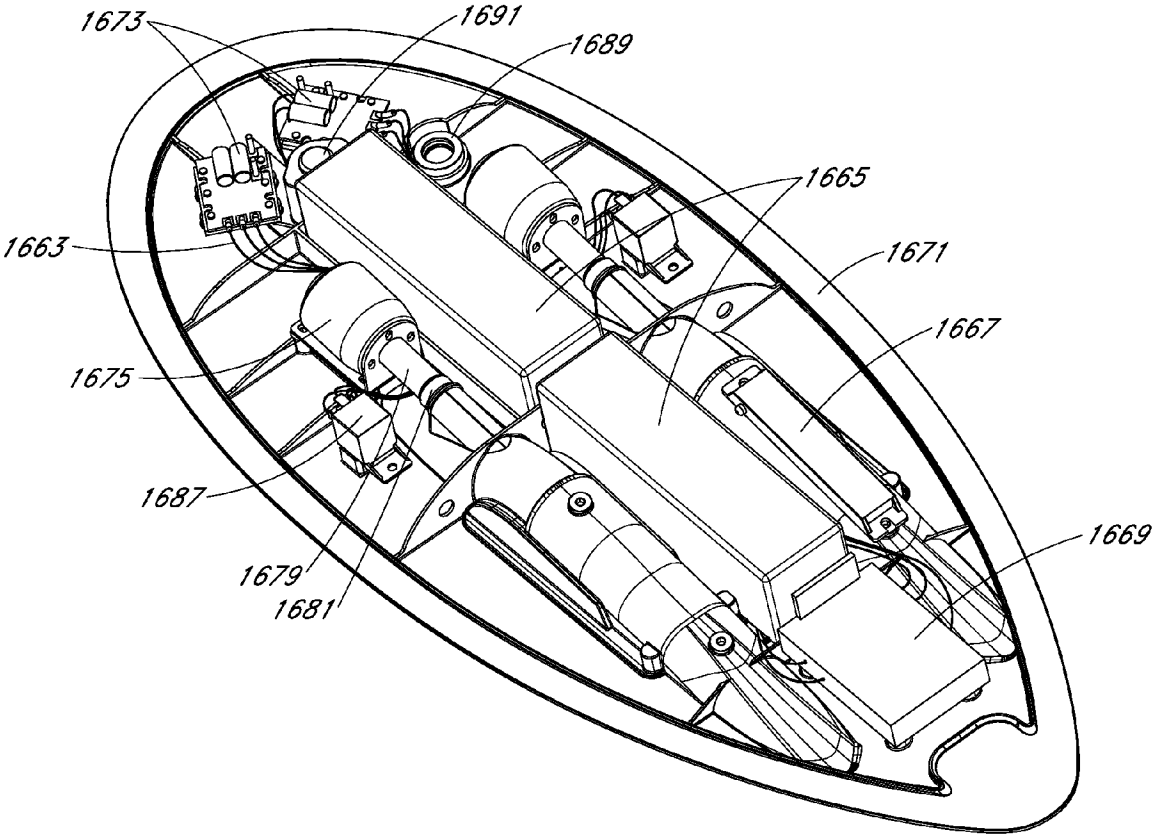
FIG. 19 is a perspective cutaway view of the motorized cassette of FIG. 18.

As shown in FIGS. 18 and 19, the removable cassette 1620 may comprise a drive system including one or more motors 1675. In one embodiment, the drive system can be at least partially housed between a cassette base 1671 and a cassette cover 1657. The one or more motors 1675 can be powered by one or more batteries 1665 and can be mounted to the cassette base 1671 by motor mounts 1677. In some embodiments, each motor 1675 can be coupled to a motor shaft 1690 by a shaft coupler 1679, shaft bearing 1681, bearing holder 1683, and spacer 1685. Each shaft 1690 can be coupled to an impeller 1699 that is disposed at least partially within a pump housing 1695 and a bearing 1697 can optionally be disposed between each shaft and the impeller 1699. In this way, the one or more motors 1675 can drive each impeller 1699 to draw water through the pump housing 1695 to propel the cassette relative to a body of water.

In some embodiments, each shaft 1690 can be disposed within a shaft housing 1694 that is configured to limit the exposure of the shaft 1690 to objects that are separate from the cassette 1620. Thus, the shaft housing 1694 can protect a user from inadvertently contacting the shaft 1690 during use and/or can protect the shaft 1690 from contacting other objects, for example, sea grass. Additionally, the shaft housing 1694 can improve performance of the cassette 1620 by isolating each shaft 1690 from the water that passes through the pump housing 1695. In some embodiments, each shaft 1690 can be protected from exposure to the water by one or more shaft seals 1692.

The cassette 1620 can also include one or more grates 1693 disposed over intake ports of the pump housing 1695. The grates 1693 can limit access to the impeller 1699 and shaft 1690 to protect these components and/or to prevent a user from inadvertently contacting these components during use. In some embodiments, each pump housing 1695 and/or grate 1693 can be coupled to one or more magnetic switches (not shown) that can deactivate the motors 1675 when the pump housing 1695 and/or grate 1693 are separated from the cassette base 1671. Therefore, the one or more magnetic switches may prevent the cassette from operating without the optional grate 1693 and/or pump housing in place.

With continued reference to FIGS. 18 and 19, the drive system may also include one or more motor controllers 1673 for each motor 1675, one or more relays 1687 configured to connect the one or more batteries 1665 with the one or more motor controllers 1673, an antenna 1667, and a transceiver 1669. The one or more motor controllers 1673, one or more relays 1687, one or more batteries 1665, antenna 1667, and transceiver 1669, can be electrically connected to each another by one or more wiring harnesses 1663. As discussed above, the transceiver 1669 can include or be coupled to wireless transmission circuitry that is configured to transmit electromagnetic and/or magnetic signals underwater.

Figure 20:
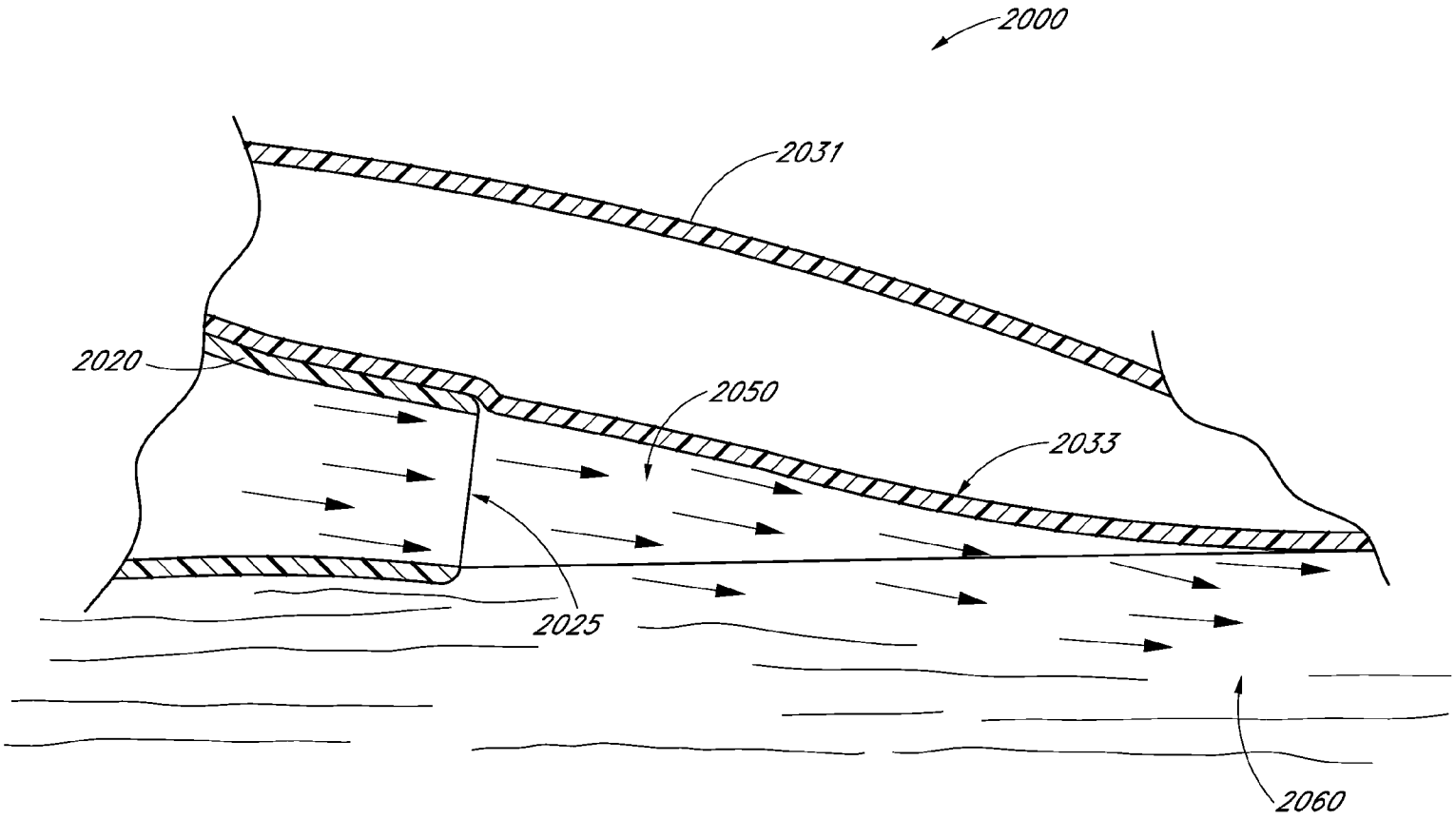
FIG. 20 is a cross-sectional view of a personal watercraft including a curved body section adjacent to the exhaust port of the pump housing.
Figure 21:
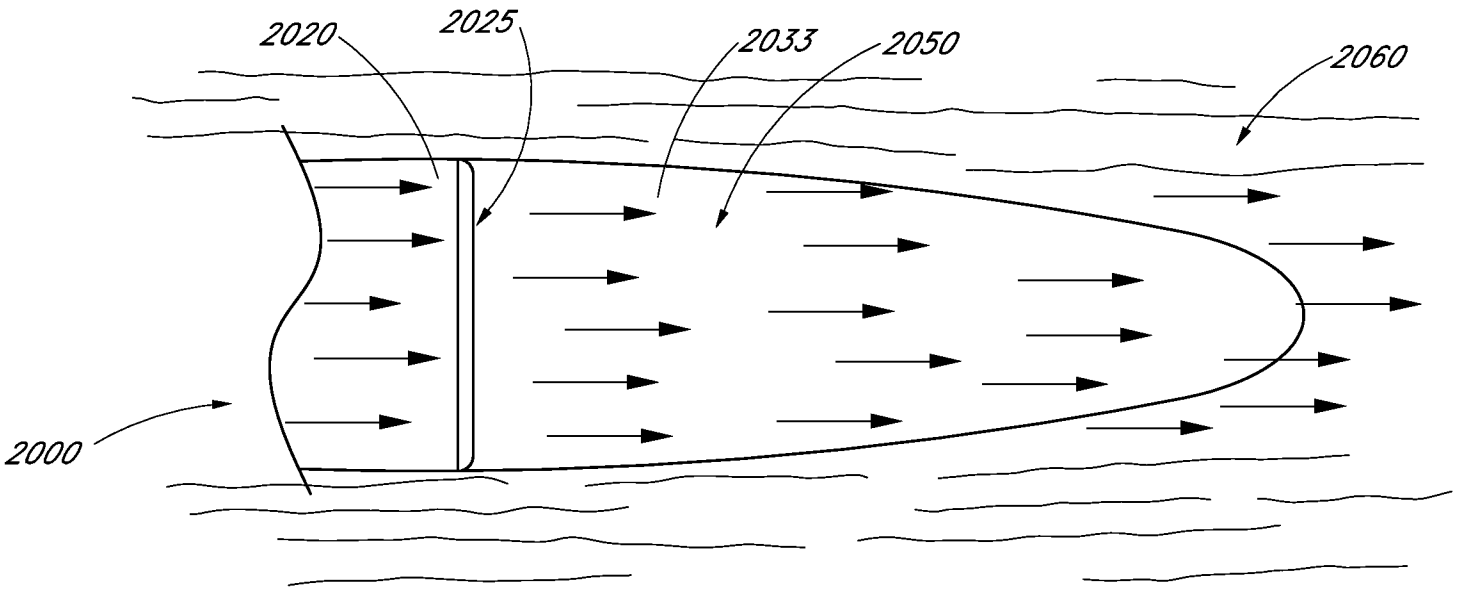
FIG. 21 is a bottom view of the personal watercraft of FIG. 20.

FIGS. 20 and 21 show a personal watercraft 2000 comprising a body 2031 having a curved section 2033 disposed adjacent to and rearward of a pump housing 2020 and pump housing exhaust port 2025. The curved section 2033 may be shaped to create a Coanda Effect to direct flow from the exhaust port 2025 to follow the curve of the curved section 2033. The Coanda Effect on the flow that exits the exhaust port 2025 can result in an effective thrust of the expelled fluid in a thrust area 2050 as the expelled fluid enters the surrounding water 2060. As used herein, the term "Coanda Effect" refers to the tendency of a fluid jet to be attracted to a nearby surface, for example, the curved section 2033 of personal watercraft 2000 body 2031. The curved section 2033 and the relative positioning of the curved section 2033 and the pump housing 2020 can be incorporated in any of the personal watercraft described herein to create a thrust area between the exhaust port 2025 and the curved section 2033.

Figure 22:
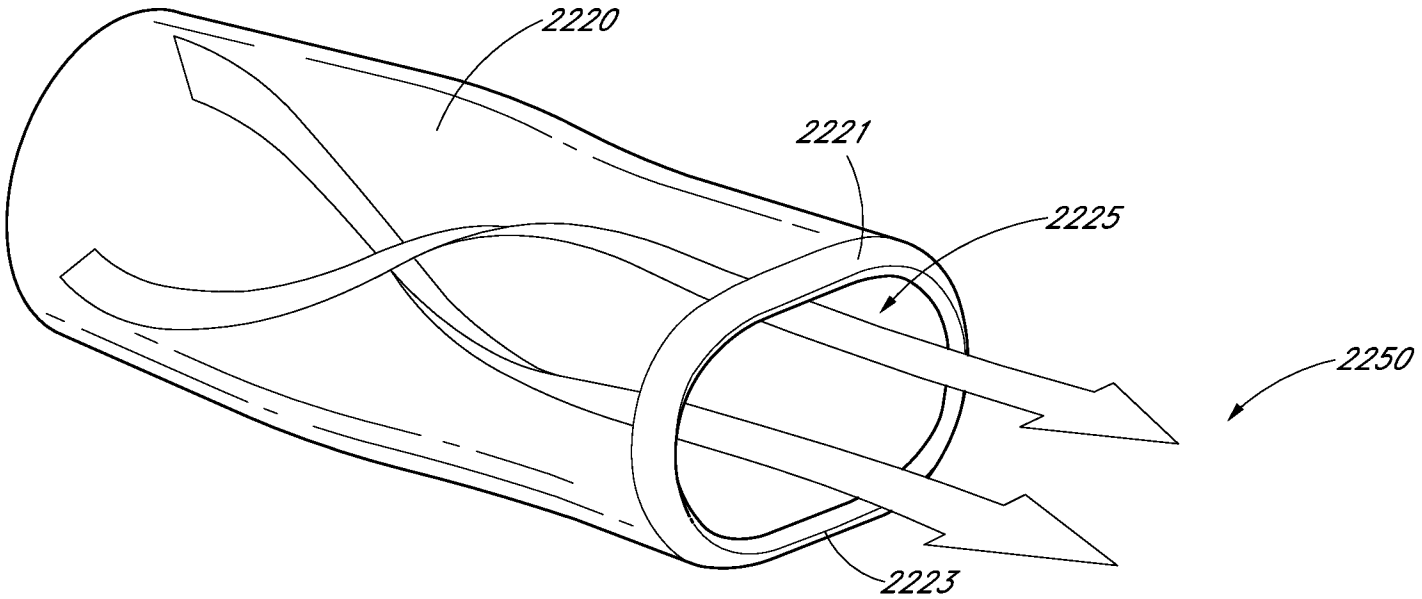
FIG. 22 is a perspective view of a pump housing including a flattened exhaust port.

FIG. 22 shows an embodiment of a pump housing 2220 having a generally curvilinear cross-sectional shape that tapers to a flattened and oblong exhaust port 2225. The exhaust port 2225 includes a first flattened side 2221 and a second flattened side 2223 disposed opposite to the first side. The first and second sides 2221, 2223 of exhaust port 2225 stabilize the rotational flow of water passing therethrough to create a more uniform flow of expelled water in the thrust area 2250 adjacent to and rearward of the exhaust port 2225. Pump housing 2220 can optionally include one or more flow straighteners, for example, flow straighteners 228 previously discussed with reference to FIGS. 2 and 3. The optional flow straighteners can be configured to stabilize the flow of water passing through the pump housing 2220 and the exhaust port 2225 can be configured to further stabilize the flow of water passing therethrough. The shape of the pump housing 2220 and the exhaust port 2225 can be incorporated in any of the personal watercraft described herein to create a more uniform flow in the thrust area adjacent to the exhaust port 2225.

What is claimed is:

1. An interchangeable motor module system comprising:

an insert configured to be secured relative to a watercraft, the insert having a top side configured to be coupled to a bottom side of the watercraft and a bottom side defining a receiving space and comprising at least one protrusion extending into the receiving space;

a motorized cassette comprising an electric drive system, the motorized cassette configured to be received at least partially within the receiving space, the motorized cassette comprising a housing having a substantially planar surface, the substantially planar surface having at least one water intake port and at least one water exhaust port disposed thereon, the at least one water intake port and at least one water exhaust port in fluid communication with the electric drive system; and at least one indentation formed in the housing, the at least one indentation configured to receive the at least one protrusion so as to inhibit movement of the motorized cassette relative to the insert in at least one direction.

2. The system of claim 1, wherein the insert comprises a latch configured to releasably secure the motorized cassette relative to the insert when the motorized cassette is at least partially received within the receiving space.

3. The system of claim 1, wherein the motorized cassette comprises an aperture, wherein the insert comprises a threaded bore, and wherein the aperture and the threaded bore are coaxially aligned when the motorized cassette is at least partially received within the receiving space.

4. The system of claim 1, wherein the motorized cassette and the receiving space are complementarily shaped.

5. The system of claim 1, wherein the electric drive system comprises at least one electric motor coupled to at least one impeller.

6. The system of claim 5, wherein the motorized cassette comprises at least one battery.

7. The system of claim 1, wherein the motorized cassette comprises at least one motor controller.

8. The system of claim 7, wherein the motor controller includes at least one wireless receiver.

9. The system of claim 8, further comprising a wireless control mechanism.

10. The system claim 1, wherein the watercraft is a surfboard.

11. The system claim 1, wherein the watercraft is a kayak.

12. The system claim 1, further comprising a non-motorized cassette configured to be received at least partially within the receiving space.

13. The system claim 1, wherein the at least one water exhaust port includes a curved section to direct flow from the exhaust port along the curved section.

14. The system claim 1, wherein the at least one water exhaust port includes one or more flow straighteners.

* * * * *

UNITED STATES PATENT AND TRADEMARK OFFICE

CERTIFICATE OF CORRECTION

PATENT NO. : 8,951,079 B2
APPLICATION NO. : 13/174277
DATED : February 10, 2015
INVENTOR(S) : Mike R. Railey It is certified that error appears in the above-identified patent and that said Letters Patent is hereby corrected as shown below:

Claims

In column 14 at line 7 (approx.), In Claim 10, after "system" insert --of--.

In column 14 at line 9 (approx.), In Claim 11, after "system" insert --of--.

In column 14 at line 10 (approx.), In Claim 12, after "system" insert --of--.

In column 14 at line 14, In Claim 13, after "system" insert --of--.

In column 14 at line 17, In Claim 14, after "system" insert --of--.

Signed and Sealed this
Tenth Day of November, 2015

Michelle K. Lee

Michelle K. Lee
*Director of the United States Patent and Trademark Office*